US008307794B2

(12) United States Patent
Lengfeld et al.

(10) Patent No.: US 8,307,794 B2
(45) Date of Patent: Nov. 13, 2012

(54) INTERNAL COMBUSTION ENGINE VALVE DRIVE SWITCHING DEVICE

(75) Inventors: Markus Lengfeld, Winnenden (DE); Jens Meintschel, Bernsdorf (DE); Thomas Stolk, Kirchheim (DE); Alexander von Gaisberg-Helfenberg, Frau Wiebke Bonn (DE)

(73) Assignee: Daimler AG, Stuttgart (DE)

( * ) Notice: Subject to any disclaimer, the term of this patent is extended or adjusted under 35 U.S.C. 154(b) by 461 days.

(21) Appl. No.: 12/658,588

(22) Filed: Feb. 8, 2010

(65) Prior Publication Data

US 2010/0199935 A1 Aug. 12, 2010

Related U.S. Application Data

(63) Continuation-in-part of application No. PCT/EP2008/006488, filed on Aug. 7, 2008.

(30) Foreign Application Priority Data

Aug. 10, 2007 (DE) ..... 10 2007 037 747

(51) Int. Cl.
*F01L 1/34* (2006.01)

(52) U.S. Cl. ..... 123/90.15; 123/90.16; 123/90.17

(58) Field of Classification Search ..... 123/90.15, 123/90.16, 90.17
See application file for complete search history.

(56) References Cited

U.S. PATENT DOCUMENTS

2007/0034184 A1* 2/2007 Dengler ..... 123/90.17

FOREIGN PATENT DOCUMENTS

| | | |
|---|---|---|
| EP | 0 798 451 | 10/1997 |
| JP | 09 035607 | 2/1997 |
| JP | 10 008928 | 1/1998 |
| JP | 2010-535966 | 11/2010 |
| JP | 2010-535967 | 11/2010 |

* cited by examiner

*Primary Examiner* — Zelalem Eshete
(74) *Attorney, Agent, or Firm* — Klaus J. Bach

(57) ABSTRACT

In an internal combustion engine valve drive switching device with a switching unit, the switching unit includes an implementation unit for implementing a first switching process based on at least one signal and thereafter, to implement a second switching process independently of an electronic evaluation.

14 Claims, 22 Drawing Sheets

INTERNAL COMBUSTION ENGINE VALVE DRIVE SWITCHING DEVICE

This is a Continuation-In-Part application of pending International patent application PCT/EP2008/006488 filed Aug. 7, 2008 and claiming the priority of German patent application 10 2007 037 747.0 filed Aug. 10, 2007.

BACKGROUND OF THE INVENTION

The invention relates to an internal combustion engine valve drive switching arrangement.

DE 10 2005 006 489 A1 discloses an internal combustion engine valve drive switching device, where switching processes are coupled to each other and are carried out simultaneously.

It is the object of the present invention to provide a valve drive switching arrangement in such a manner that installed size and weight of the arrangement are relatively low and a high operating safety is achieved.

SUMMARY OF THE INVENTION

In an internal combustion engine valve drive switching device with a switching unit, the switching unit includes an implementation unit for implementing a first switching process based on at least one signal and thereafter, to implement a second switching process independently of an electronic evaluation.

A "switching unit" is a unit which is provided to effect a switching process of at least one valve drive. "Provided" is meant to be specially equipped and/or designed. A "signal" indicates a triggering process and/or a sign, as for example a current pulse with a defined meaning and/or an acting upon and/or positioning of a mechanical component in a switching position and/dr mechanical interaction initiated from outside of the implementation unit. A "triggering process" is a mechanical, electrical, quantum-mechanical, and/or electromechanical process, which can result in a certain positioning of a switching means. An "implementation unit" is a unit which carries out at least one process one time based on a signal and which can especially comprise mechanical, quantum-mechanical, electrical and/or electromechanical components, and especially also electronic components, if these do not influence the process in an inessential manner and especially preferred do not influence the process at all. A "switching process" is a relative movement and especially an axial relative movement between two components. A switching process taking place "after" another switching process means that the switching processes take place in an at least a chronologically offset manner and preferred in a chronologically overlap-free manner. An electronic "evaluation" means an electronic classifying and/or assessing of a state and/or a signal and/or a process. An implementation being "independent" of an electronic evaluation means an automated implementing in a mechanical, quantum-mechanical, electrical and/or electromechanical manner. A simple construction of the switching unit can be achieved with an arrangement according to the invention.

In a preferred embodiment of the invention, the implementation unit is formed at least partially as a mechanical unit. Construction costs can be saved hereby.

It is additionally suggested that the implementation unit is at least partially in the form of a transmission. A simple construction of the implementation unit can be achieved thereby. The transmission can especially be in the form of a cam transmission. Other motion transmissions which appear to be sensible to the expert are also conceivable, as for example gear transmissions, lever transmissions, hydraulic transmissions etc.

The implementation unit is advantageously provided to effect a switching of a valve drive and/or a change of at least one valve lift curve and/or a switch-off of at least one valve and/or at least a change of operating modi of an internal combustion engine. A simple and efficient operation of the valves of a valve drive can be achieved hereby. A "valve drive" is especially meant to be a constructional unit which is provided to permit a gas change at least partially in internal combustion engines, which are based on a piston machine. A "switching" of a valve drive is especially meant to be a process for changing at least one property and/or at least one function of the valve drive and/or the change between different operating modi. A "valve lift curve" is meant to be the graph of the function which is obtained when the valve lift relative to the cylinder with which the valve is associated is measured, is plotted over the rotary angle of the drive shaft associated with the valve drive in a cartesian coordinate system. "Different operating modi" is especially meant to be the actuation of valves with different control times and/or valve lift curves. A "change of the operating modi" is here especially meant to be the operation of the internal combustion engine with full load, with partial load, in the self-ignition operation, with cylinder switch-off, with early or late inlet closure or further operating modi which appear sensible to the expert.

In an advantageous arrangement of the invention, the implementation unit comprises at least one switching means and is provided to implement the switching units independently of each other at least in dependence on the positions of the switching units relative to the switching means in at least one operating mode. The number of the required switching means can be reduced thereby. A "switching means" is especially meant to be a means, which is provided to effect a switching process, especially also with a cooperation with at least one switching means or another unit. A "switching unit" is a unit, which is provided to effect a switching process, especially also with a cooperation with at least one switching means or another unit. The implementation unit "actuating" a switching unit means a cooperation and/or interaction of the implementation unit or parts of the implementation unit with the switching unit, which can effect a switching process. The implementation unit actuating the switching units "independently from each other" means that an actuation of a switching unit by the implementation unit does not influence an actuation of another switching unit by the implementation unit. An "operating mode" means a type of an operation.

In a preferred arrangement of the invention, the implementation unit has at least two switching units and at least one switching means, which is provided to actuate the at least two switching units at least partially chronologically offset in at least one operating mode. The number of the required switching means can be reduced hereby.

It is additionally suggested that the implementation unit has at least two switching units and at least one switching means, which is provided to actuate at least one of the switching units in dependence on at least one position change of to at least one of the switching units relative to the switching means. The number of the required switching units and the number of the required switching means can be reduced hereby.

It is further suggested that the implementation unit has at least two switching means associated with two different switching directions. A switching process can thereby be designed in a manner which saves components. A "switching direction" is especially meant to be a direction, in which a component is moved relative to the switching means with a switching process effected at least partially by the switching means, especially in a translational manner. Superposed movements, such as translational and rotating movements, are also conceivable in principle.

The implementation unit advantageously has at least one switching means and two switching units corresponding to the switching means, and the switching units are at least partially decoupled in their movement. The switching units can thereby be moved in different directions relative to the switching means. A switching unit can especially rest relative to the switching means, while another switching unit moves relative to the switching means. A switching unit "corresponding" to a switching means is especially meant to be a switching unit, which is formed in such a manner that it enables a switching process in a cooperation with the switching means. Switching units at least partially "decoupled" in their movement are switching units for which at least one movement of a switching unit relative to the other switching unit is independent in at least one operating mode.

It is further suggested that the implementation unit is capable of actuating at least two switching units simultaneously in at least one operating mode. Hereby, it can be achieved in a constructively simple manner that a switching means can actuate two switching units at least in a partially decoupled manner.

In a preferred embodiment of the invention, the implementation unit has at least two switching units and at least two control means which are positioned at adjacent ends of at least two switching units of the implementation unit. The extension of the individual control means can thereby especially be reduced. A "control means" is a means for controlling a process, especially for controlling a switching process. The switching units can especially be associated with different valves, which can be associated with different cylinders. The switching units may also be associated with only one valve for a particularly flexible switching.

The control means preferably form at least one control track. A switching device for switching processes between the switching units and the switching means can thereby be realized in a simple manner. A "control track" is formed by spaced guide walls, which are provided to guide a switching means during at least one switching process, and which extend individually or together over a defined angular region, preferably over more than 10°, over more than 80°, and often over more than 180° in the circumferential direction of a drive shaft or a component connected to the drive shaft, wherein the clearances can be separated spatially from each other and this spatial separation can be cancelled by a switching process. A "clearance" is meant to be an elevation or a recess, which can have different extension forms which appear sensible to the expert, as especially an elongated extension form. A clearance can be a slot or a groove. A "slot" is meant to be a small recess. An "elevation" is an elevated location compared to the area surrounding the location and/or a bulge.

In a preferred arrangement of the invention, the internal combustion engine valve drive comprises at least one control track which is formed by at least two switching units of the implementation unit. A switching device for switching processes can thereby be realized in an especially simple manner, with which the switching units participate.

The control unit is preferably formed in such a manner that the switching units can be actuated by a switching means in a defined switching sequence. The control tracks can thereby be used in a continuous operation. A "defined switching sequence" refers to switching processes taking place in a determined order and with an at least partially chronological offset. They may be separate switching processes, which are especially also suitable for a continuous operation including at least two defined switching sequences.

It is further suggested that the implementation unit has at least one control track and at least one switching means, which are provided to effect a switching of a valve drive by an interaction with the control track. A reliable change of valve lift curves can be achieved hereby.

The implementation unit preferably has at least one switching means, and a switching unit having at least one control means, wherein the control means and the switching means are provided to change at least one function of the switching unit and/or of the switching means based on an interaction amongst each other. A compact switching design can be achieved hereby. A "function" is a mode of operation and especially a mode of operation during an interaction with another constructional unit, which can for example be the switching means or the switching unit.

In this connection, an advantage can be achieved if the function is a plunging of the switching means into the switching unit and/or a pushing out of the switching means from the switching unit and/or an actuation of the switching unit and/or a change-over of the switching means from one switching unit to another switching unit and/or a resting of the movement of a switching unit. An effective mechanical switching device can be realized thereby. A "plunging" of the switching means into the switching unit is an insertion of the switching means in the form of an elevation or a pin into a groove or a slot of a switching unit. A "pushing out" of the switching means from the switching unit is the removal of the switching means formed as an elevation or a pin by pushing it from the groove or the slot of the switching unit. A "resting" of the movement of a switching unit is further meant to be an immobilization of the switching unit relative to the switching means after a movement of the switching unit relative to the switching means.

At least one switching means is preferably provided to act upon a control track in at least one radial direction. A constructively simple interaction between the switching means and the control track can be achieved thereby. A "radial direction" is especially meant to be a radial direction in relation to a drive shaft. An "acting upon" the control track by the switching means means that the switching means impinges during a movement and is subjected thereby to a force.

It is additionally suggested that in connection with a camshaft the implementation unit includes at least to a large part the switching units through which valve lift curves of valves associated with the camshaft can be changed, and at least one switching means is provided to actuate the switching units. A coherent switching can be achieved hereby and a faulty switching of individual cams can thereby be prevented. A "large part" are especially meant to be at least 50 percent, especially at least seventy percent, and especially advantageously at least ninety percent of the total number. A valve shall especially be "associated" with a camshaft, when the valve is opened and/or closed directly or indirectly by means of the camshaft.

The implementation unit preferably comprises a switching means, which is formed as a switching pin. A cost-effective arrangement of the switching means is thereby possible.

The implementation unit advantageously has at least one switching unit and at least one switching means, which is provided to effect an axial displacement of the switching unit relative to the switching means by an interaction with each other, and thereby effect a switching of at least one valve drive. The valve drive can hereby be switched in a constructively simple manner. An "axial" displacement of the switching unit is a displacement of the switching unit in a main extension direction of a drive shaft, which can be a camshaft.

It is further suggested that the implementation unit has at least one switching unit, which is formed as an axially displaceable part of a camshaft with cams with at least partially different contours. In this manner, the switching unit can directly carry out a switching process at a cam. A "cam" is a cam-like projection on a shaft rotating in an operating mode, which can be formed as a camshaft. An "at least partially differently formed contour" is especially meant to be a different extension of the projections of different cams and/or of a cam.

In a preferred embodiment of the invention, the implementation unit has at least one switching unit, which has at least two switching elements effecting at least one switching process in dependence on their position relative to each other. All valve lift curves of a camshaft can be changed hereby, so that it is avoided that the valves of a camshaft are operated unintentionally with different valve lift curves and that the exhaust gas emission of the internal combustion engine are influenced in a disadvantageous manner.

The implementation unit preferably comprises at least one switching unit with at least one energy storage element, which is provided to store energy discharged during a switching process at least partially. The number of switching means required for a camshaft can be reduced in this manner. The energy storage element can thereby be formed of different mechanical, chemical and/or electrical storage elements which appear sensible to the expert.

The energy storage element advantageously effects a switching process by means of a stored energy, whereby an advantageous usage of the energy can be achieved, and especially a chronologically delayed axial displacement of a cam can be achieved hereby relative to the actuation of the switching unit by the switching means.

In one embodiment, the implementation unit has a switching means, which is in the form of a connecting rod so that it can be integrated in a constructively simple and space-saving manner. Preferably energy storage elements in the form of springs are used for a switching process.

It is further suggested that the implementation unit has at least one switching means, at least one rotor, and at least one threaded spindle, which is provided to displace the switching means axially in cooperation with the rotor. An advantageous force flow can be achieved hereby, and mechanical energy of a rotational movement can be stored in the energy storage elements in a constructively simple manner.

The invention will become more readily apparent from the following description thereof with reference to the accompanying drawings, which show various embodiments of the invention.

BRIEF DESCRIPTION OF THE DRAWINGS

It is shown in.

DETAILED DESCRIPTION OF PREFERRED EMBODIMENTS

Figure 1:
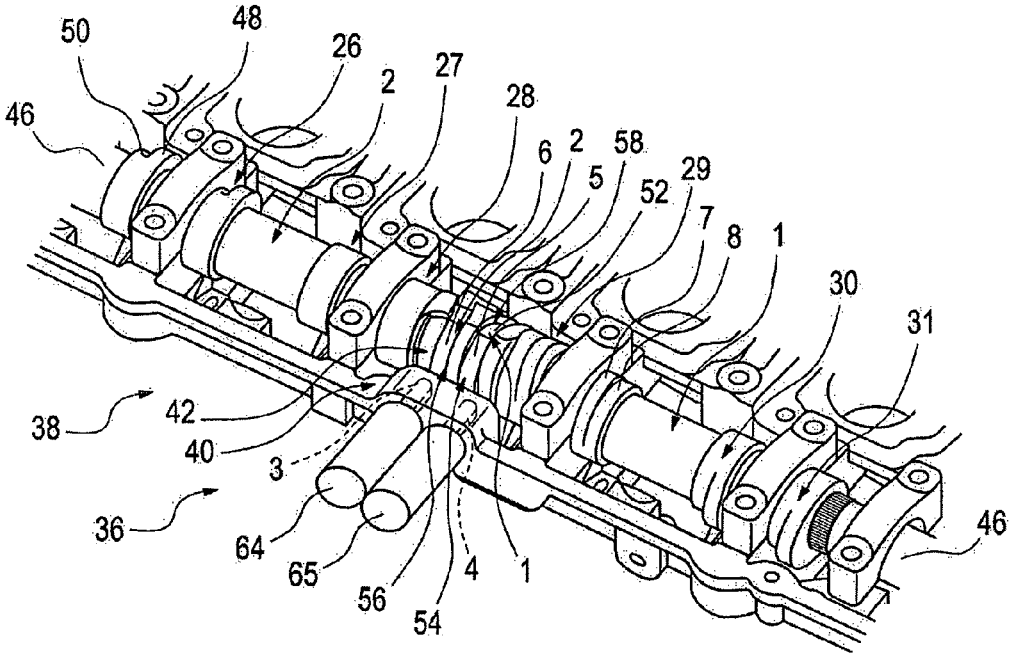
FIG. 1 parts of an internal combustion engine valve drive switching device with a switching unit, FIG. 2 a development of a control track, FIG. 3 a top view of developments of two control tracks, FIGS. 4*a* and 4*b*. an intermediate state during a first step of a switching process to the right, FIGS. 5*a* and 5*b*. an intermediate state during a second step of a switching process to the right, FIGS. 6*a* and 6*b* an intermediate state during a third step of a switching process to the right, FIGS. 7*a* and 7*b* an intermediate state during a fourth step of a switching process to the right, FIGS. 8*a* and 8*b* an intermediate state during a fifth step of a switching process to the right, FIGS. 9*a* and 9*b* an intermediate state during a sixth step of a switching process to the right, FIGS. 10*a* and 10*b* an intermediate state during a seventh step of a switching process to the right, FIGS. 11*a* and 11*b* an intermediate state during an eighth step of a switching process to the right, FIGS. 12*a* and 12*b* an intermediate state during a first step of a switching process to the left, FIG. 13*a* and 13*b* an intermediate state during a second step of a switching process to the left, FIGS. 14*a* and 14*b* an intermediate state during a third step of a switching process to the left, FIGS. 15*a* and 15*b* an intermediate state during a fourth step of a switching process to the left, FIGS. 16*a* and 16*b* an intermediate state during a fifth step of a switching process to the left, FIGS. 17*a* and 17*b* an intermediate state during a sixth step of a switching process to the left, FIGS. 18*a* and 18*b* an intermediate state during a seventh step of a switching process to the left, FIGS. 19*a* and 19*b* an intermediate state during an eighth step of a switching process to the left, FIG. 20 a section through an alternative embodiment of an internal combustion engine valve drive switching device with an implementation unit, FIG. 21 a part of a switching unit, FIG. 22 a part of a camshaft and FIG. 23 a part of the implementation unit.

FIG. 1 shows an internal combustion engine valve drive switching device with a switching unit 36, which has two actuators 64, 65, a camshaft 46 and an implementation unit 38, which is provided to perform a first switching process based on a signal, and thereafter, a second switching process, independently of an electronic evaluation. The implementation unit 38 only has mechanical components and is thus formed as a mechanical unit 40. The implementation unit 38 further comprises two switching means 3, 4 respectively formed by a switching pins, which can be actuated by the actuators 64, 65 or moved out of the actuators 64, 65. The implementation unit 38 additionally comprises switching units 1, 2, which are part of the camshaft 46. The switching units 1, 2 have a common main extension direction, which coincides with a main extension direction of the camshaft 46. The switching means 3, 4 also have a common main extension direction, which extends radially to the camshaft 46 and the switching units 1, 2.

The switching means 3, 4 are respectively provided to actuate the two switching units 1,2. During the extension of a switching means 3, 4 in its main extension direction towards the switching units 1, 2, first a switching unit 1, 2 is acted upon. Then an interaction occurs between the switching means 3, 4 and the switching units 1, 2, which is described based on FIGS. 4*a* to 19*b*, and the switching units 1, 2 are axially displaced relative to the switching means 3, 4 along the main extension direction of the switching units 1, 2. An axial displacement of cams 7, 8, 48, 50, 26, 27, 28, 29, 30, 31 associated with the switching unit 1, 2 takes place with the axial displacement of the switching units 1, 2. The cams 7, 8 and 48, 50 have a different contour so that the maximum radial extension of the cams 8, 50 is different from the maximum radial extension of the cams 48, 7. As the camshaft 46 only comprises the cams 7, 8, 48, 50, 26, 27, 28, 29, 30, 31, both switching means 3, 4 can respectively change the switching units 1, 2, by which valve lift curves of valves can be changed, which are associated with the camshaft 46.

The switching unit 1 has a control means 52, which is formed by sections 9, 11, 13, 16, 18 (see FIG. 3), which are formed by four grooves. The switching unit 2 further has a control means 54, which is formed by sections 10, 12, 14, 15, 17 (see FIG. 3), which are formed by four grooves. The control means 52, 54 are positioned in end regions or on ends 56, 58 of the switching units 1, 2, which face each other in the main extension direction of the camshaft 46 and are directly adjacent to each other. The control means 52, 54 form two control tracks 5, 6, which are arranged behind each other in the main extension direction of the camshaft 46. The control tracks 5, 6 are thus respectively formed by the two switching units 1, 2.

The switching means 3, 4 are arranged in such a manner that they can act upon the control tracks 5, 6 in the radial direction during a switching process. The switching means 3, 4 are arranged successively along the main extension direction of the camshaft 46 in the same sequence as the control tracks 6, 5. The switching means 3 can act upon the control track 6 and the switching means 4 can act upon the control track 5.

Figure 2:
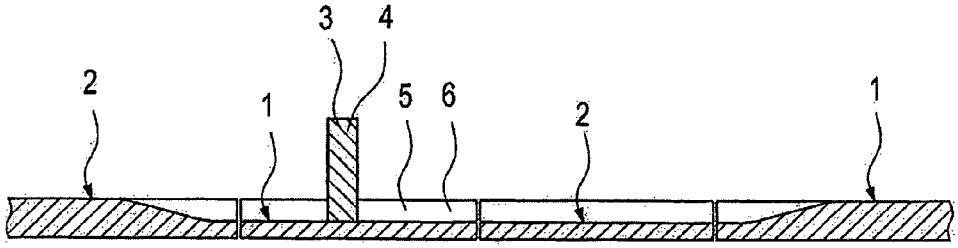

FIG. 2 shows a development of one of the control tracks 5 or 6, which extends over more than one camshaft rotation, namely over about 540°. Other angular regions which appear to be sensible to the expert are also conceivable.

According to the invention, each of the control tracks 5, 6 permits a change of the switching means 3, 4 during a switching process from one switching unit 2 to another switching unit 1 and back.

Figure 3:
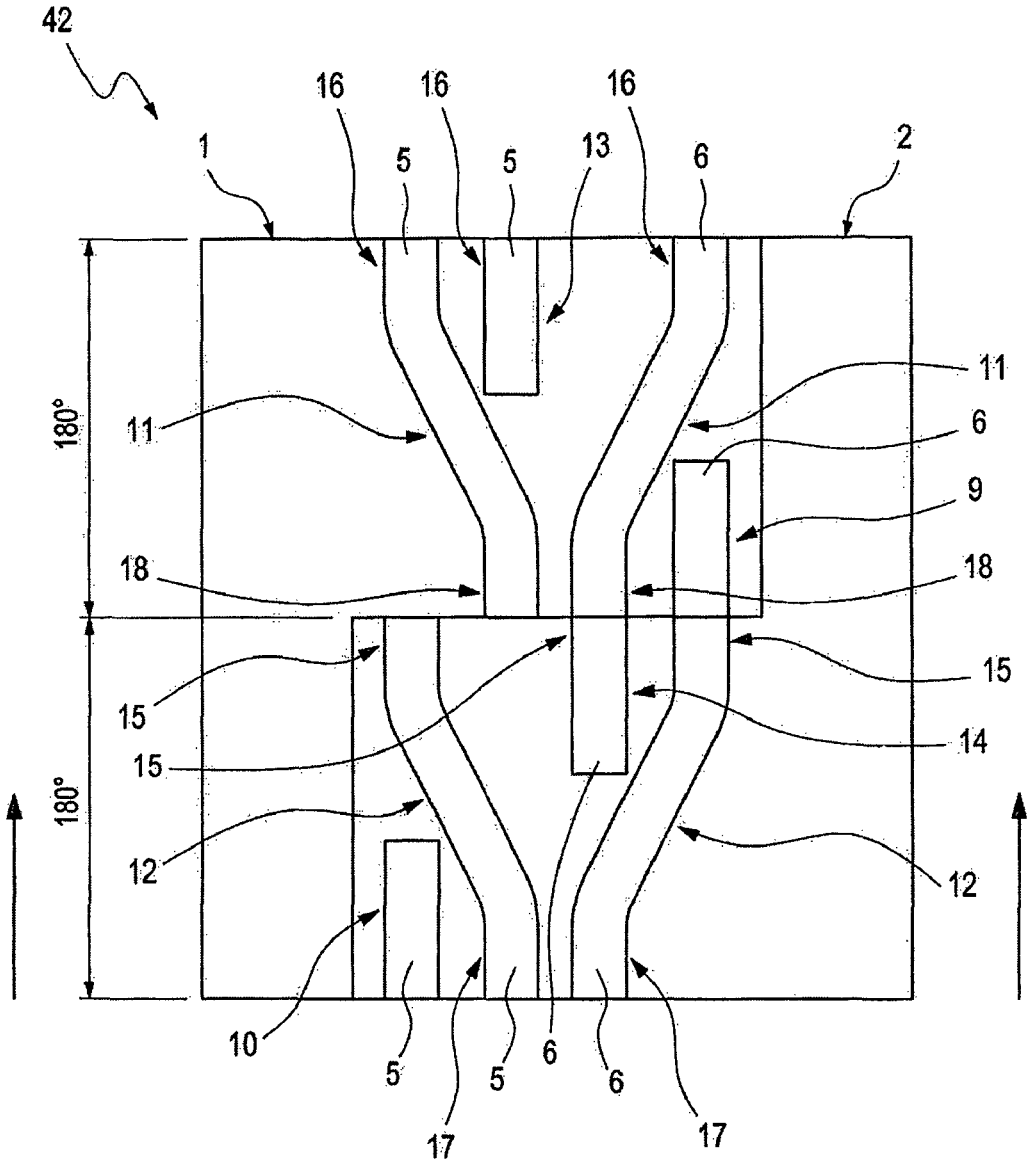
Figure 4B:
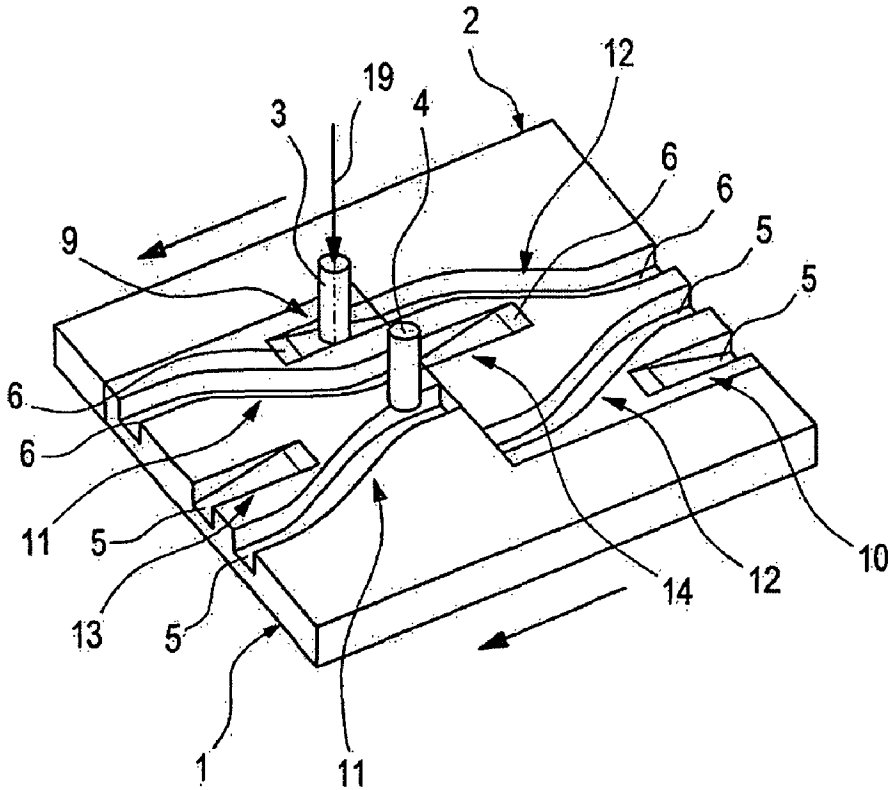
Figure 4A:
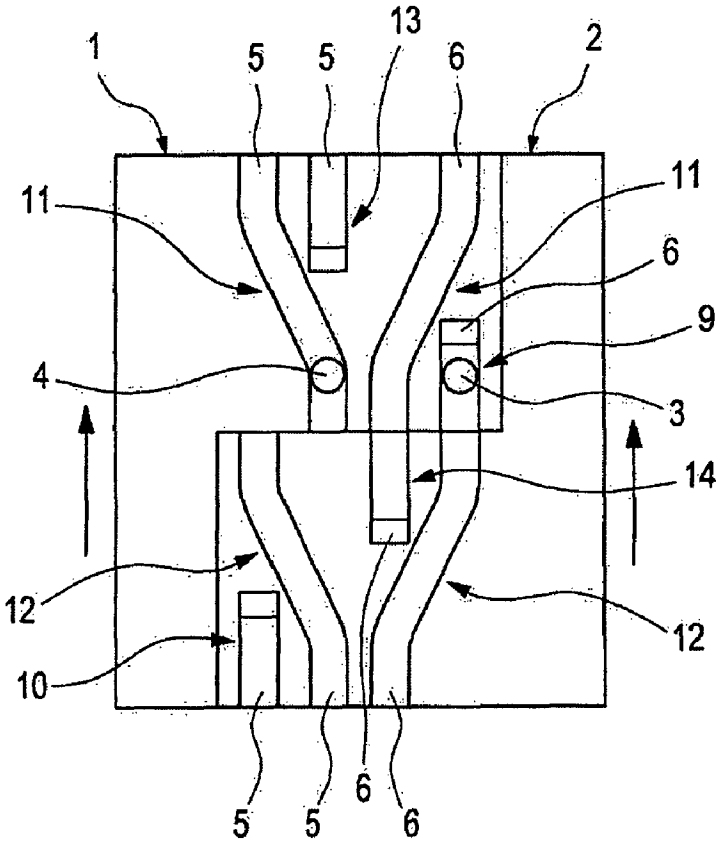
Figure 5B:
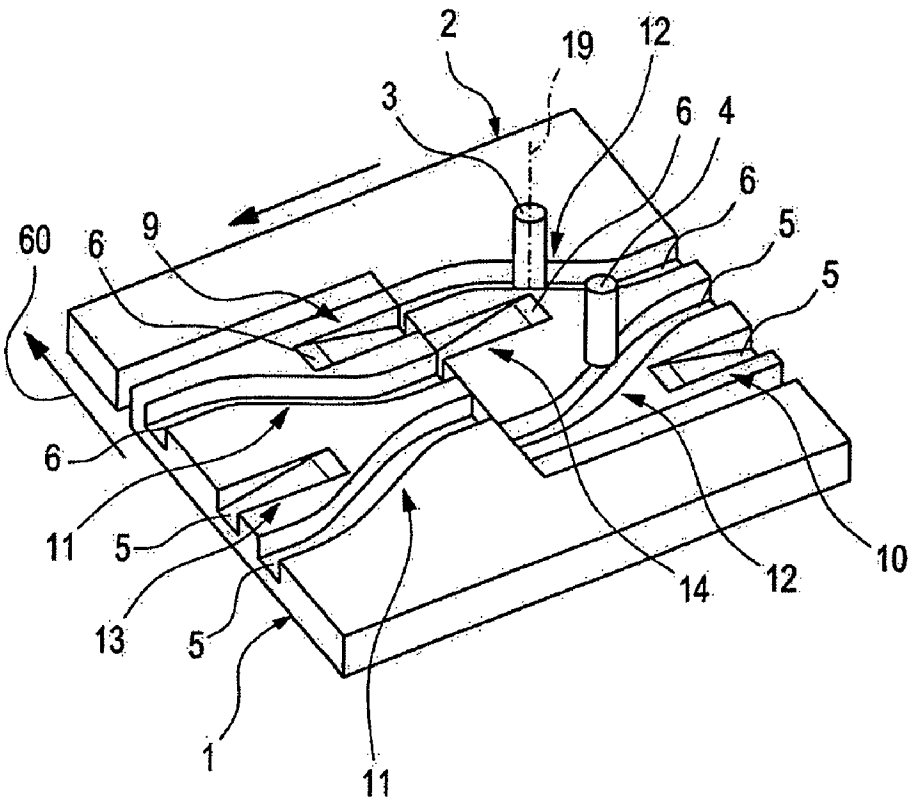
Figure 5A:
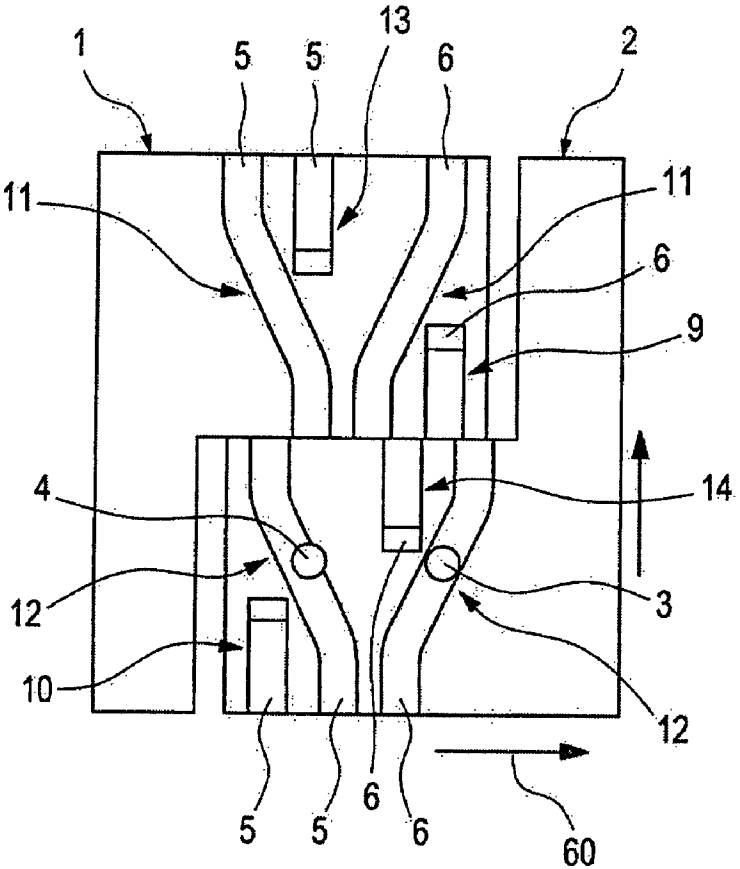
Figure 6B:
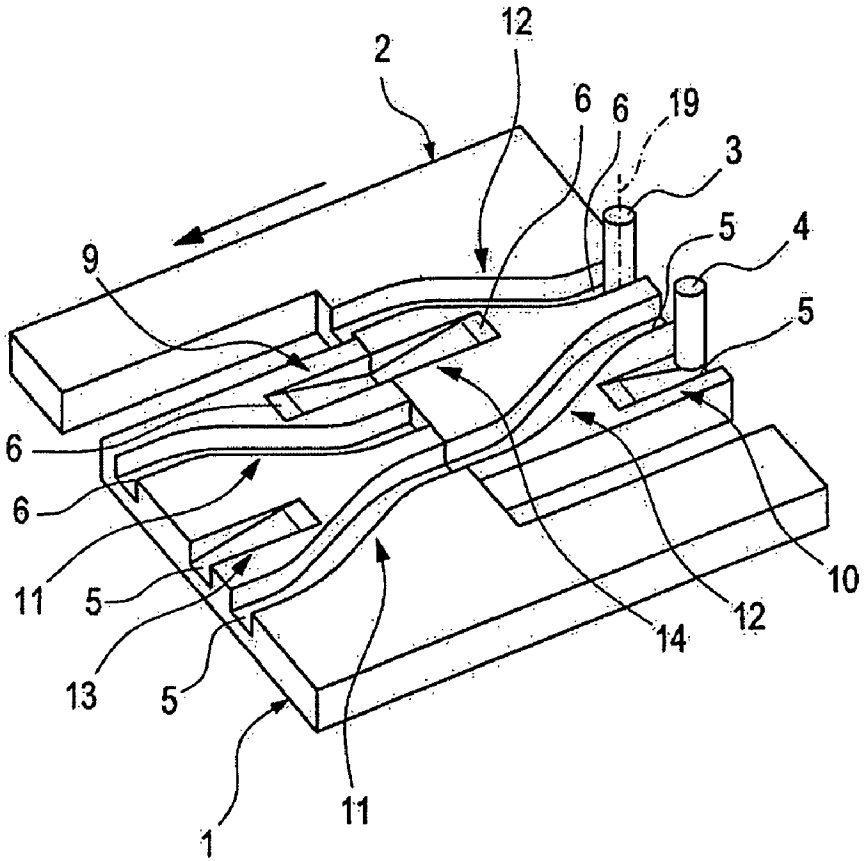
Figure 6A:
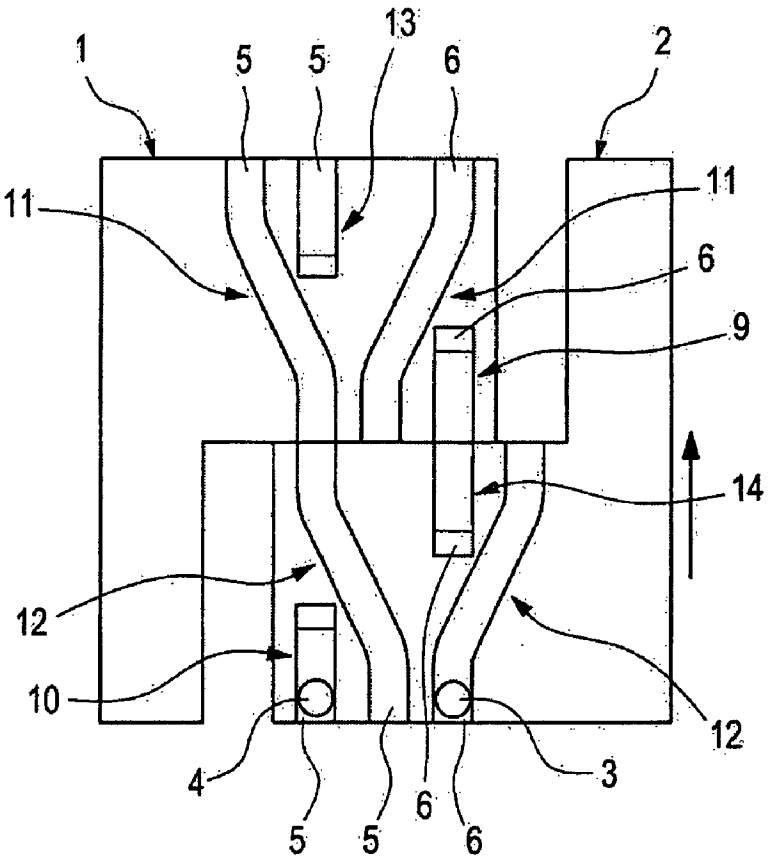
Figure 7B:
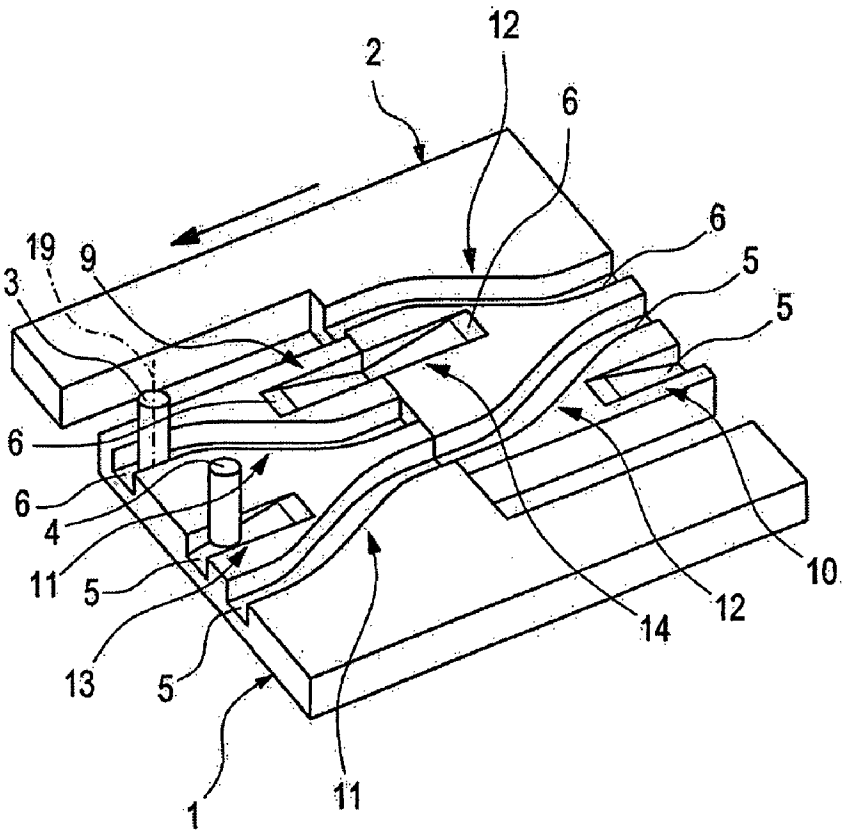
Figure 7A:
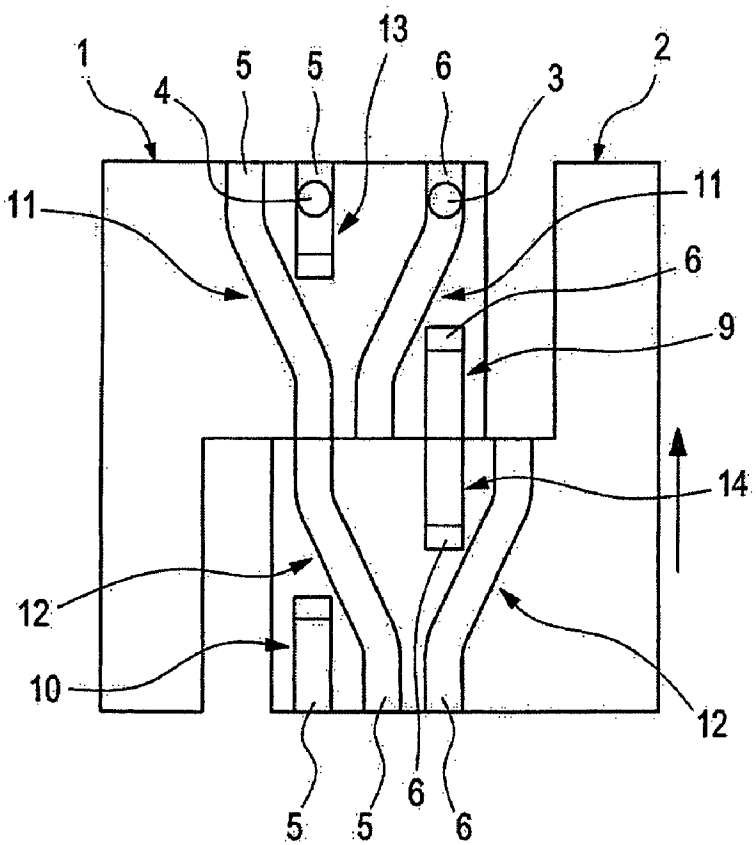
Figure 8B:
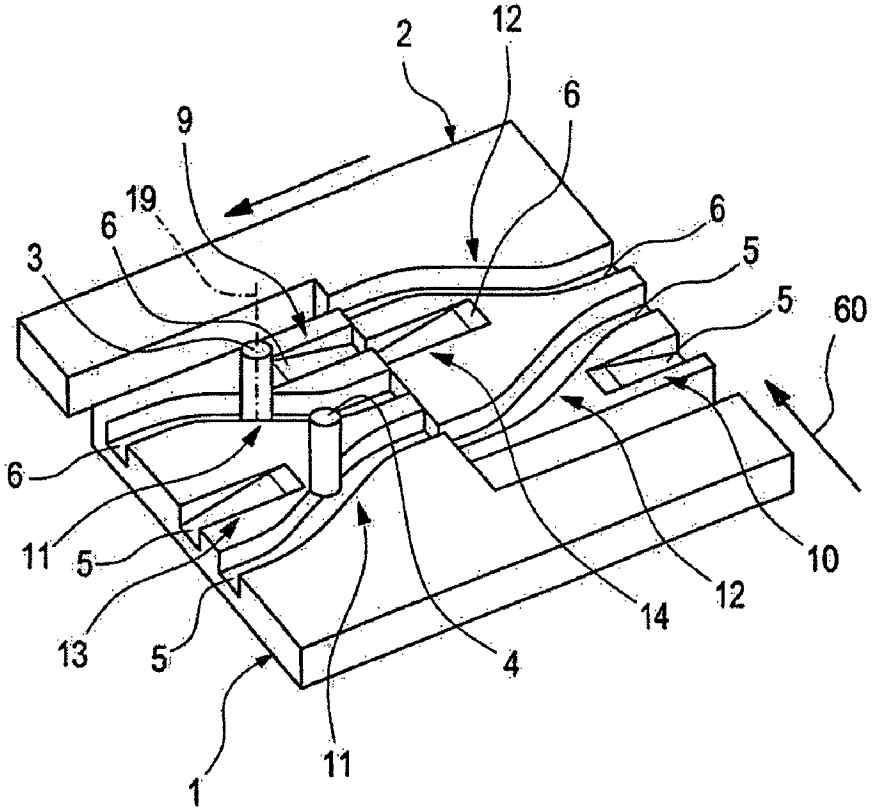
Figure 8A:
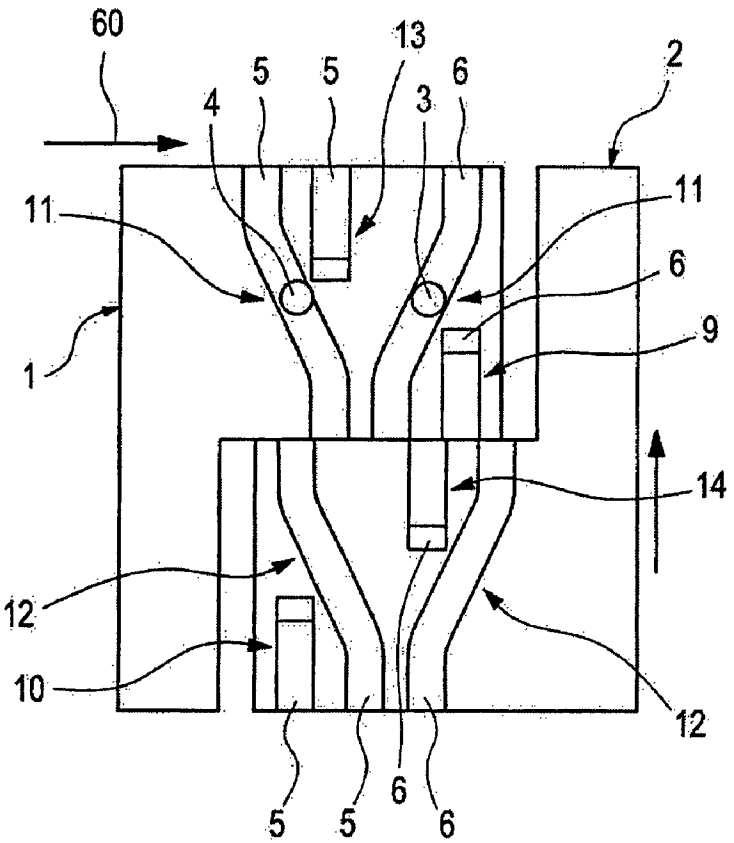
Figure 9B:
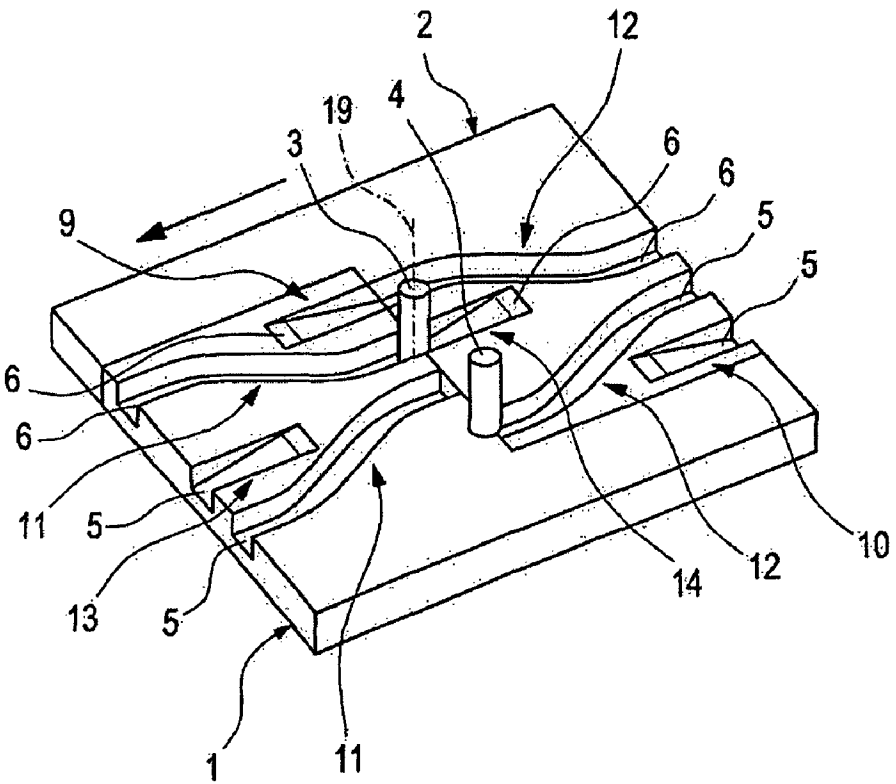
Figure 9A:
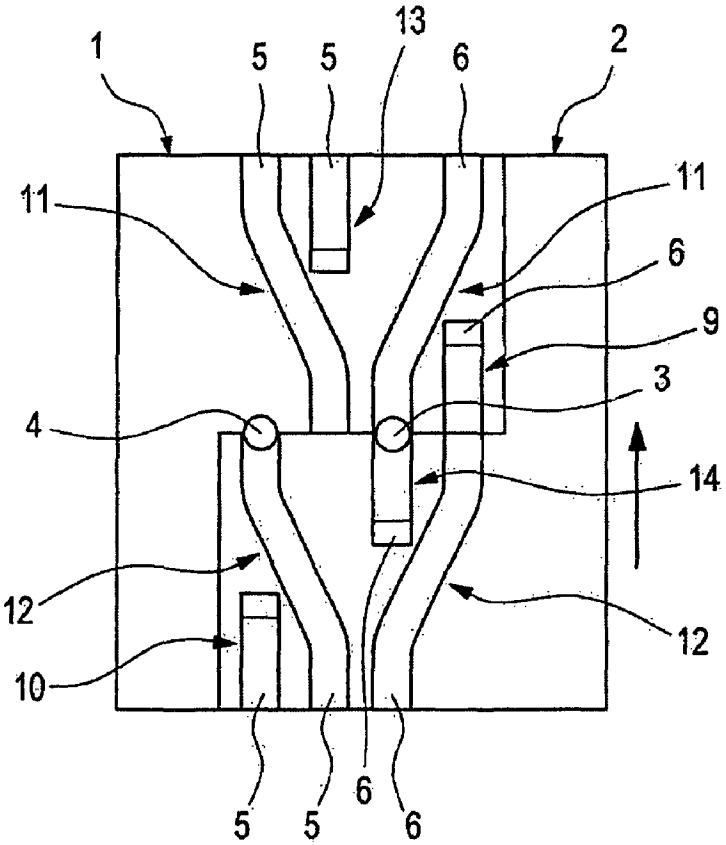
Figure 10B:
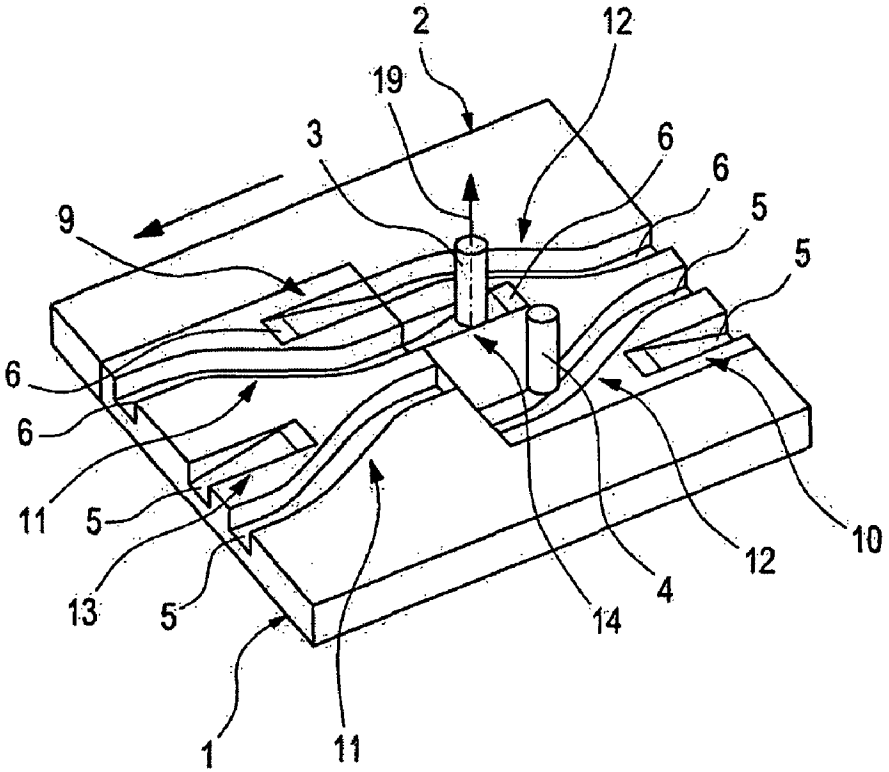
Figure 10A:
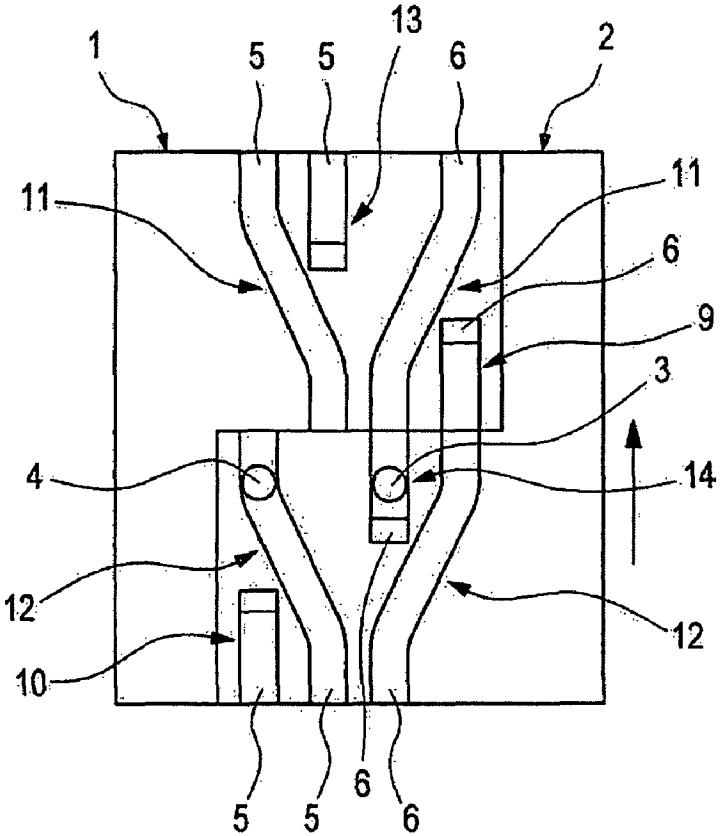
Figure 11B:
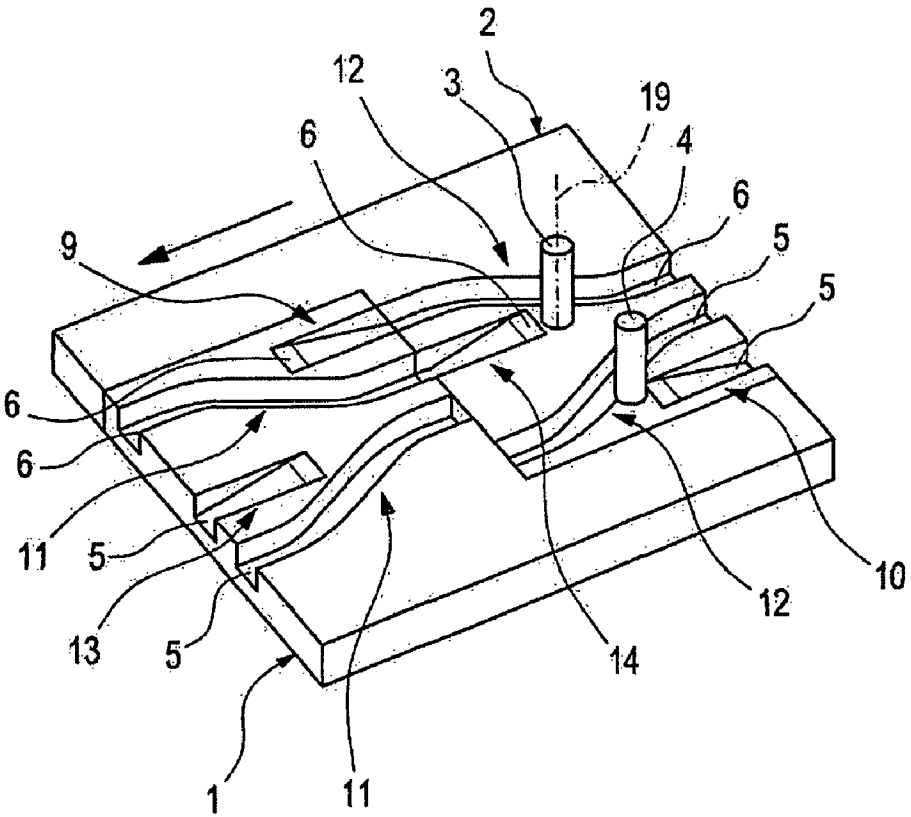
Figure 11A:
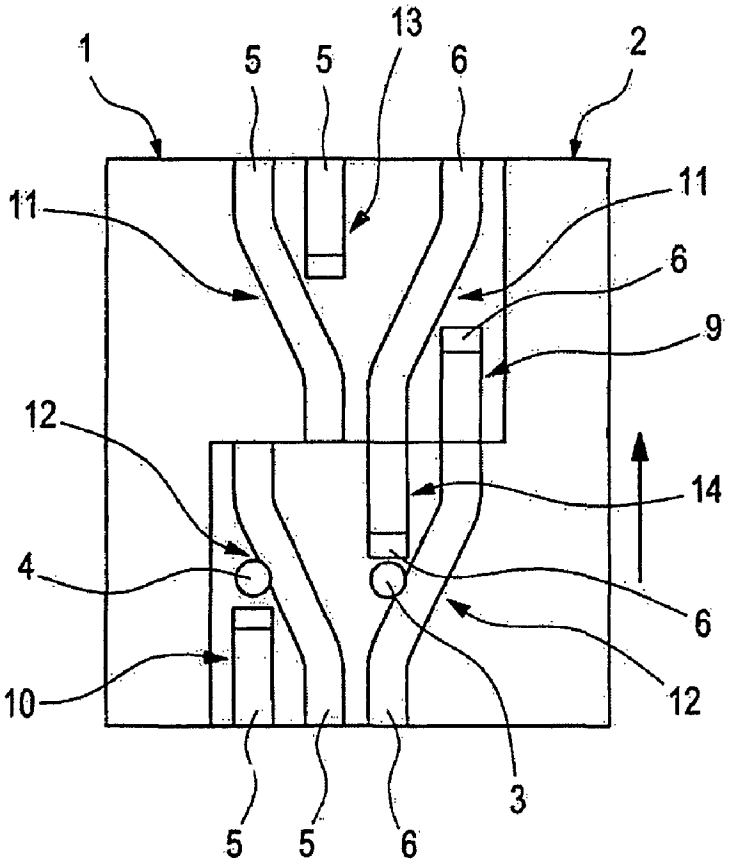
Figure 12B:
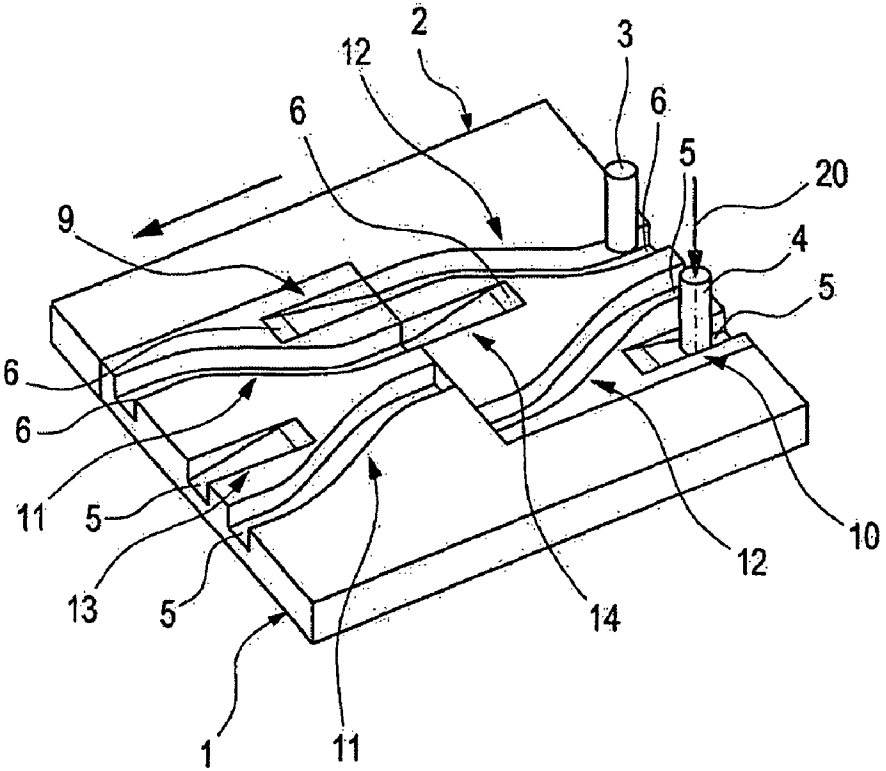
Figure 12A:
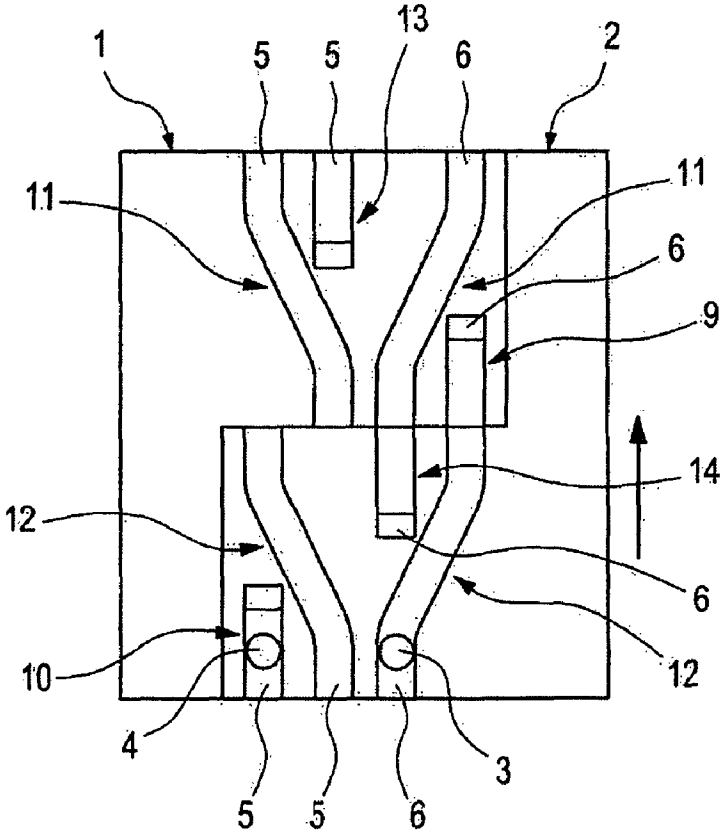
Figure 13B:
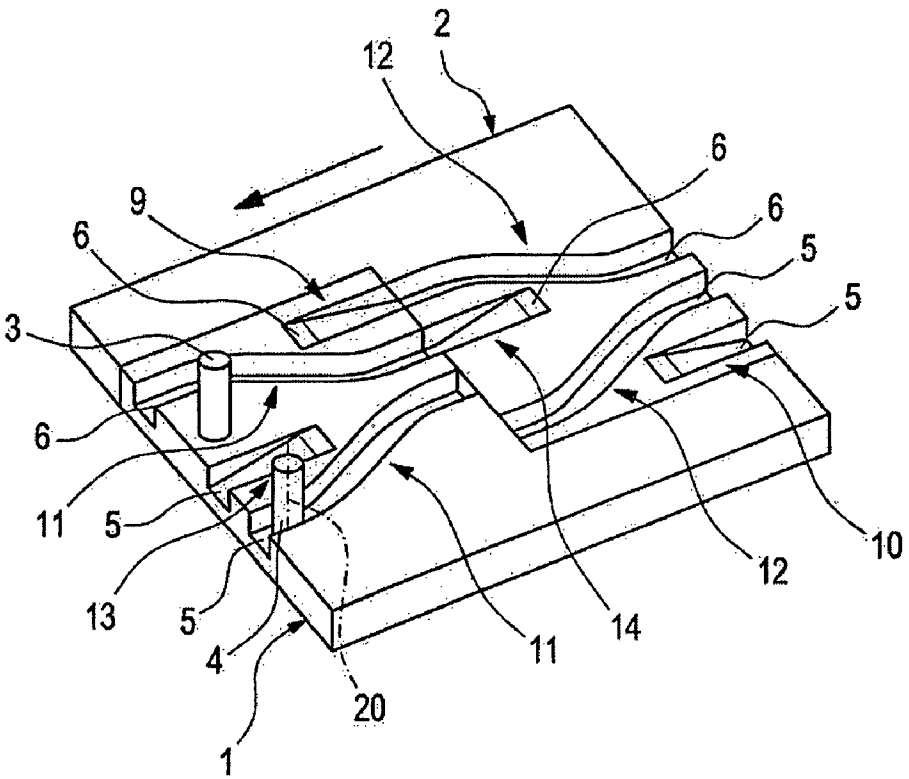
Figure 13A:
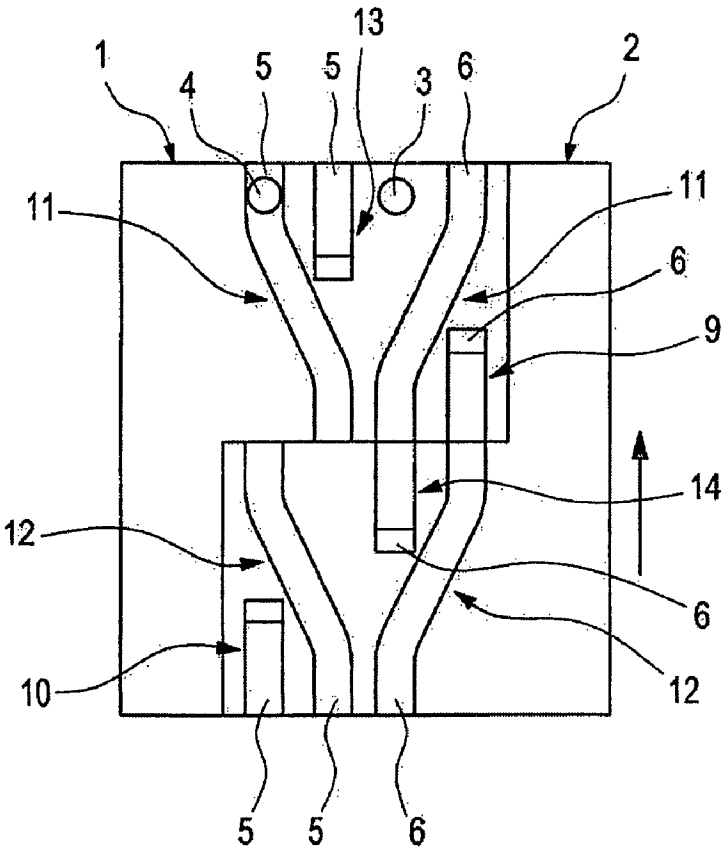
Figure 14B:
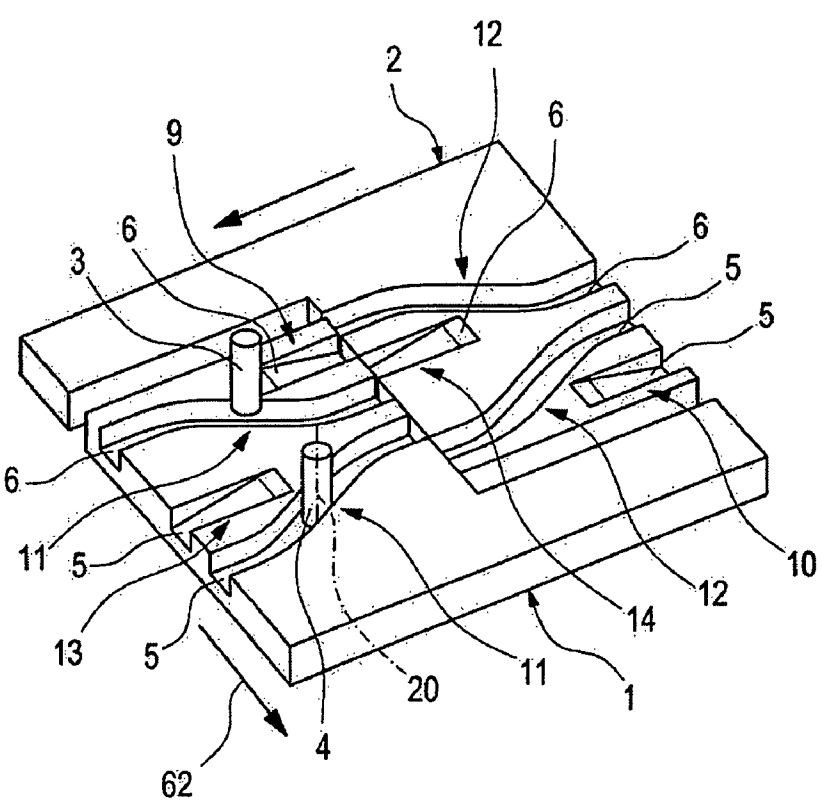
Figure 14A:
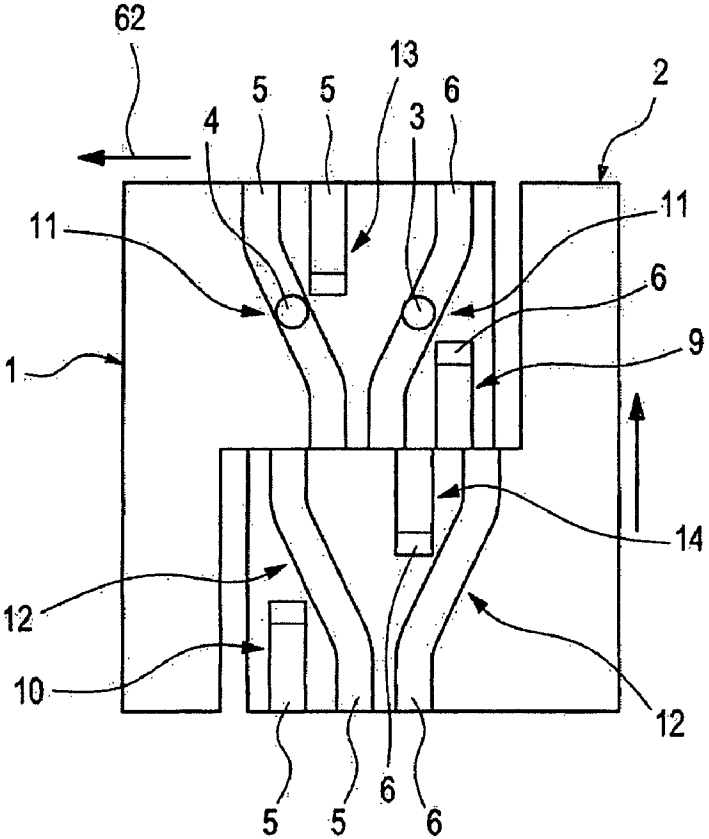
Figure 15B:
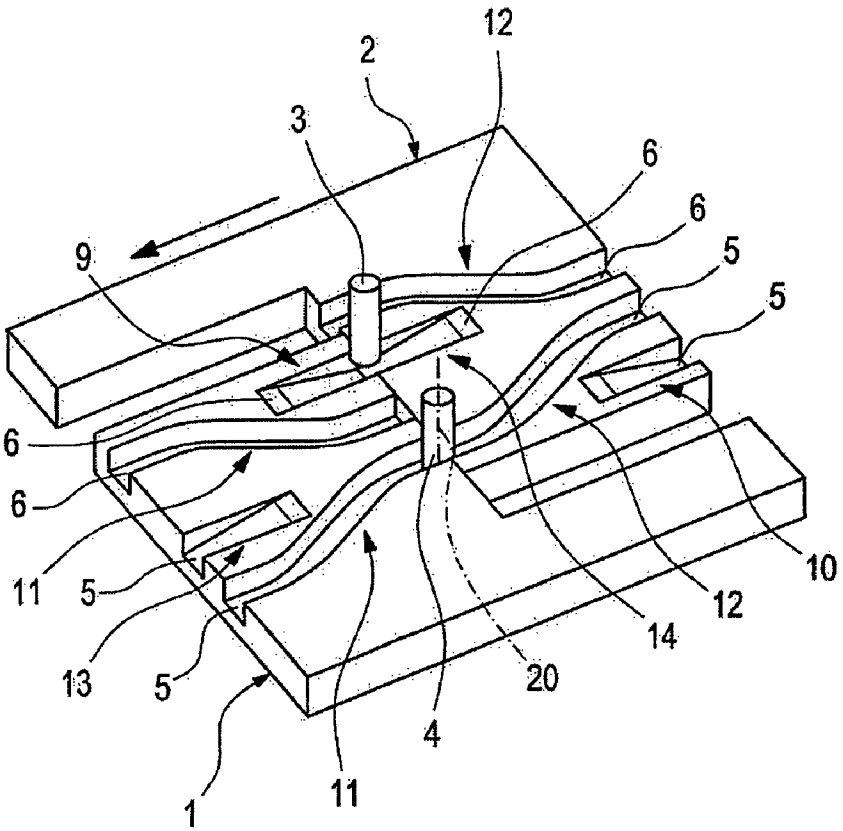
Figure 15A:
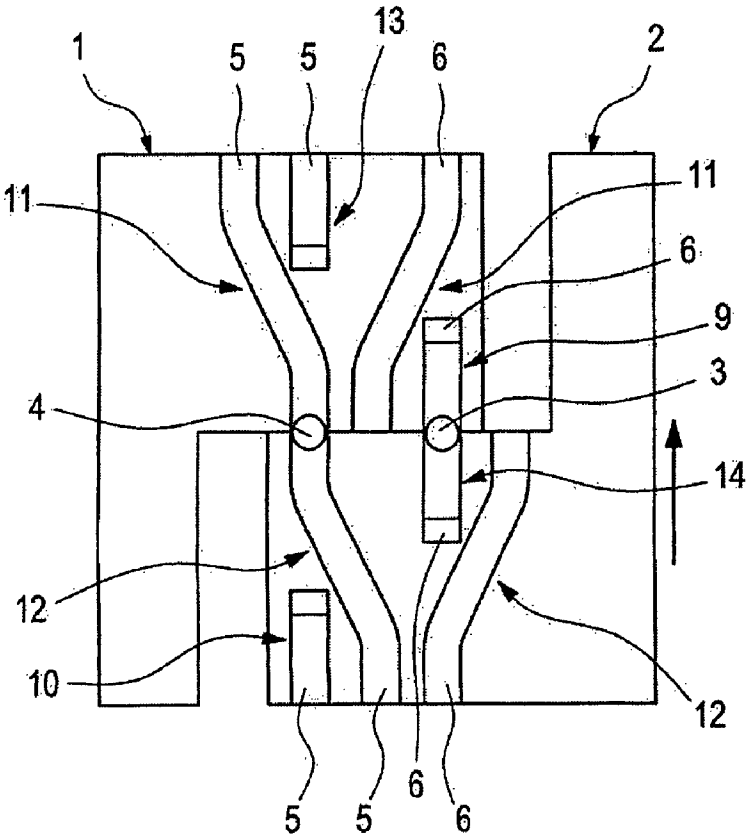
Figure 16B:
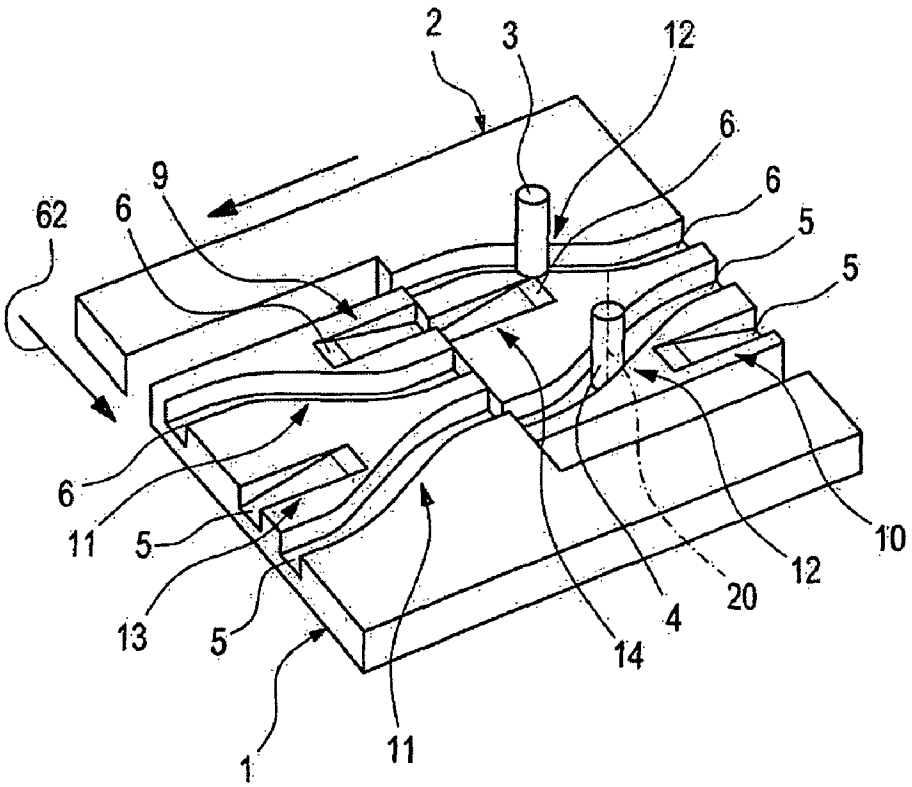
Figure 16A:
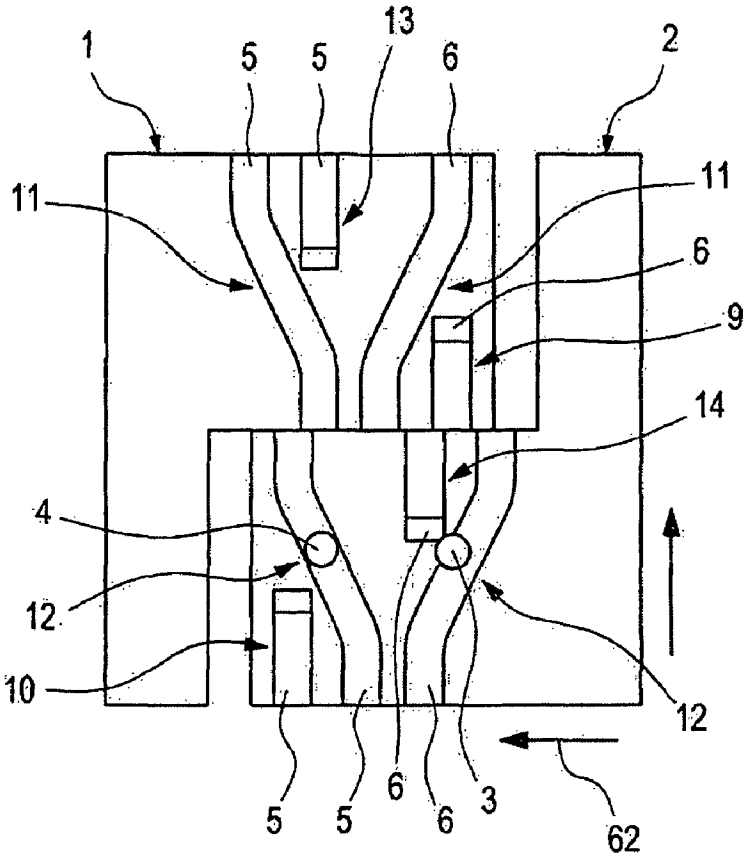
Figure 17B:
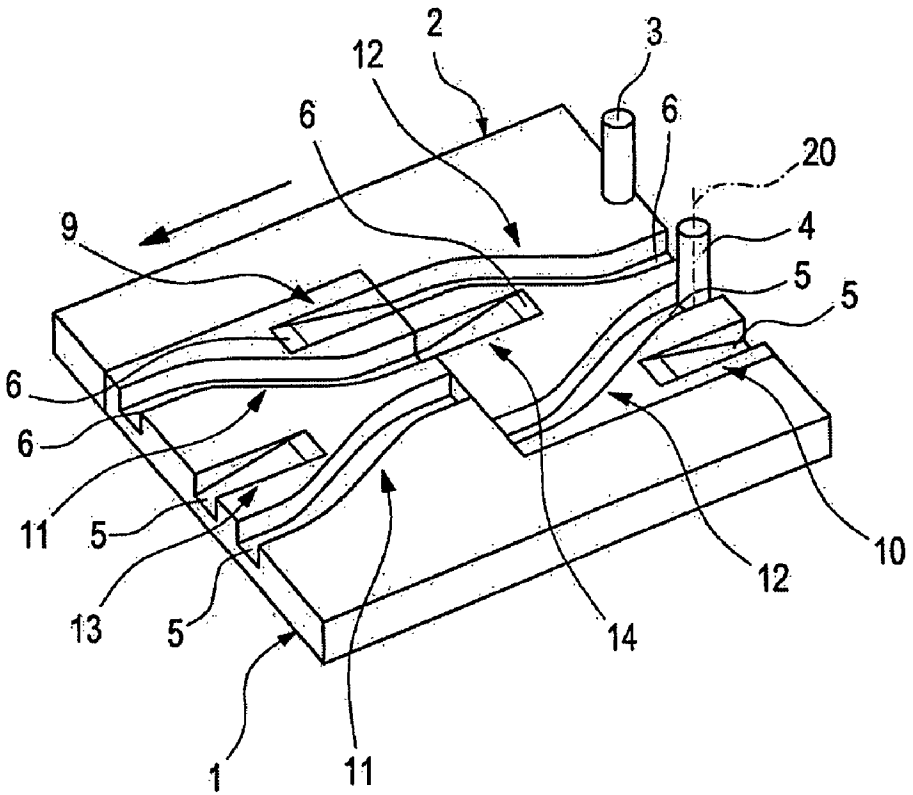
Figure 17A:
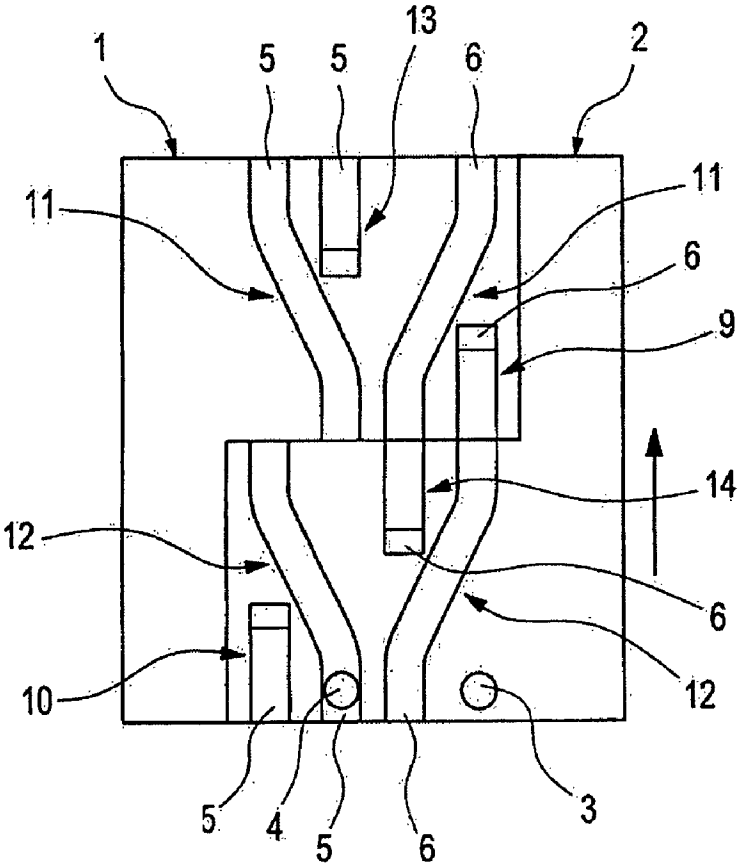
Figure 18B:
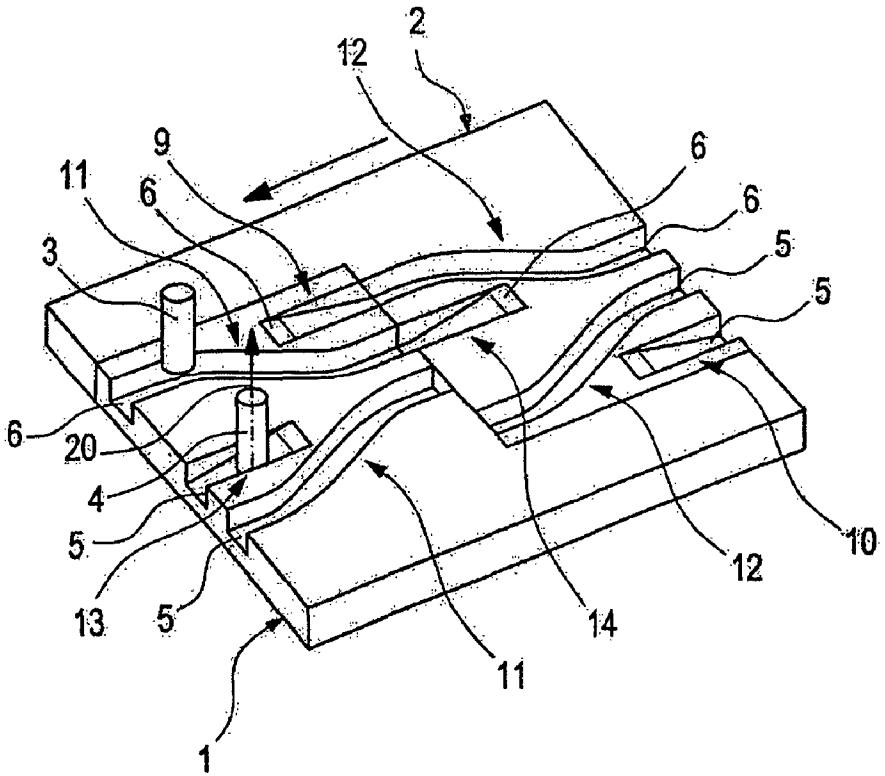
Figure 18A:
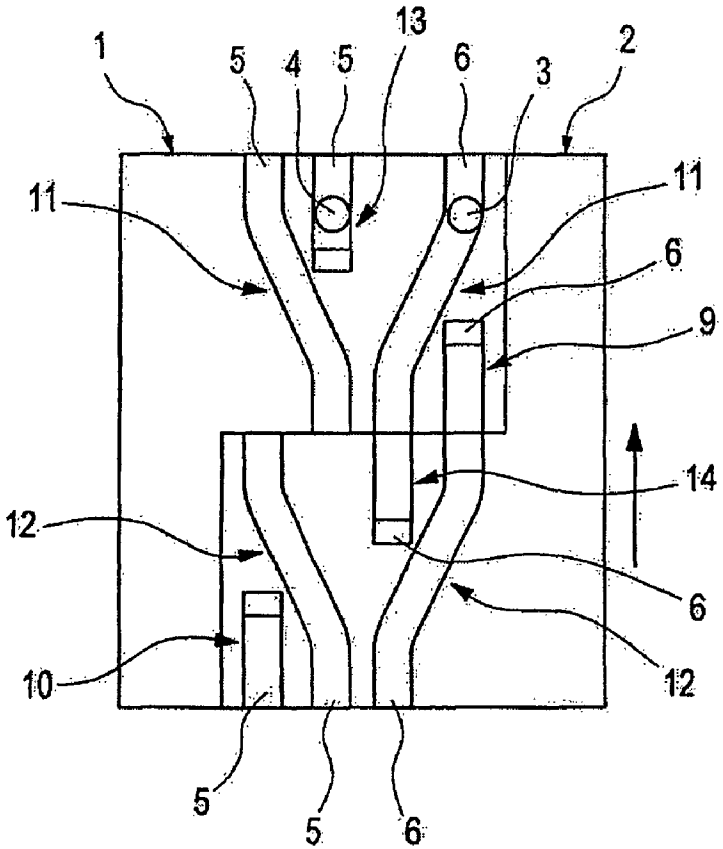
Figure 19B:
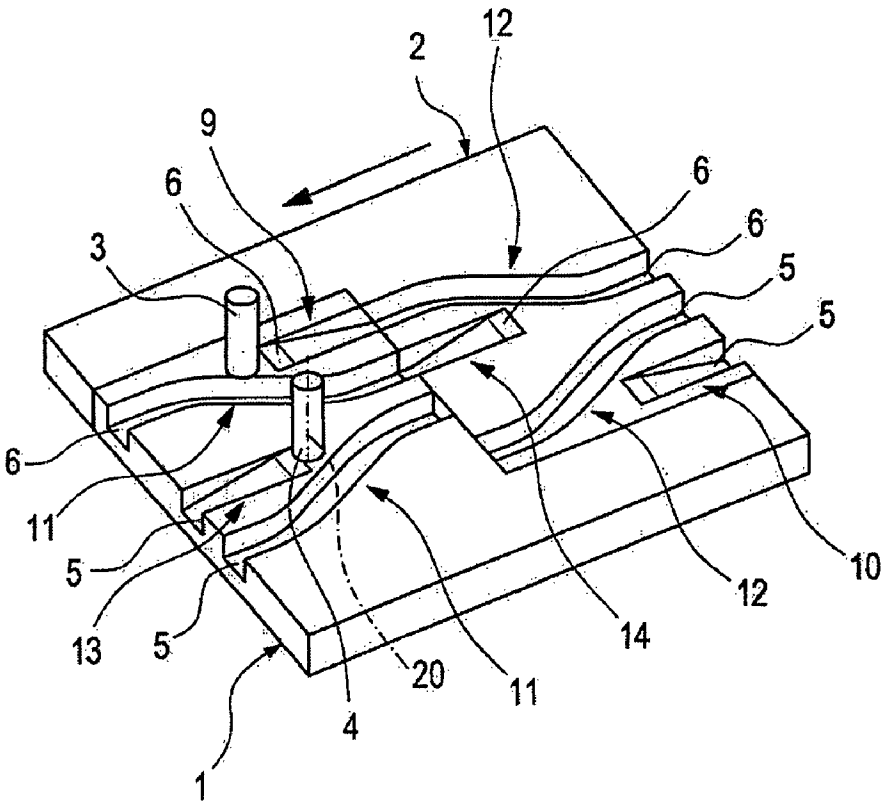
Figure 19A:
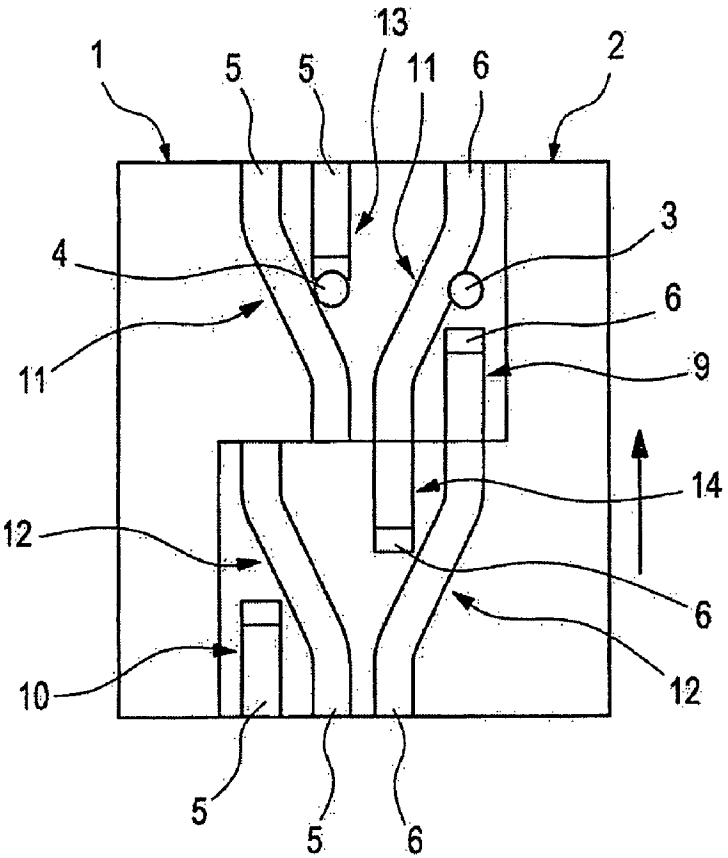

FIG. 3 schematically shows a top view of the developments of the control tracks 5 and 6, which form a transmission 42, which is formed as a cam transmission. The development of the two control tracks 5, 6 is formed by two L-shaped parts of a development of the switching units 1, 2, which have a rectangular form between two switching processes, with which different switching processes participate. A L-shaped part respectively comprises two halves of the control tracks 5, 6, which are part of different control tracks 5, 6. The control tracks 5, 6 have the sections 9 to 18, which are in interaction with the switching means 3, 4, which effect different functions of the switching means 3, 4 and/or of the switching units 1, 2 in interaction with the switching means 3, 4, wherein the different sections 9 to 18 of the control tracks 5, 6 reach an operative connection with the switching means 3, 4 in dependence on the rotary angle of the camshaft 46 (see FIG. 1).

The sections 9 to 18 are plunging sections 9 and 10, actuation sections 11 and 12, push-out sections 13 and 14, change-over sections 15 and 16, and resting sections 17 and 18. The functions are a plunging of the switching means 3, 4 into the plunging section 9, 10 of the control track 5 or 6, a pushing out of the switching means 3, 4 from a push-out section 13, 14 of the control track 5 or 6, an actuation of at least one of the switching units 1 or 2 by displacing the switching unit 1, 2 via the switching means 3, 4 present in the actuation section 11, 12, a change-over of the switching means 3, 4 from one of the switching units to another switching unit 1, 2 and a resting of the switching movement of one of the switching units 1, 2. The switching means 3, 4 reach an operative connection with the sections 9 to 18 in a different sequence in dependence on the rotary direction of the camshaft 46.

FIGS. 4*a*, 4*b* to 11*a*, 11*b* and 12*a*, 12*b* to 19*a*, 19*b* show by the presentation of individual intermediate states switching of valve drives, which are actuated by the cams 7, 8, 48, 50 of the camshaft 46 (see FIG. 1), by axial displacement of the two switching units 1, 2, wherein the switching process to the right is shown in FIGS. 4*a*, 4*b* to 11*a*, 11*b*, and the switching process to the left is shown in FIGS. 12*a*, 12*b* to 19*a*, 19*b*. During the switching process to the left, the switching units 1, 2 move in such a manner that the ends 56, 58 move relative to the switching means 3, 4 in the direction of the cams 48, 50 in a main extension direction 62 (see FIGS. 16*a* and *b*) of the camshaft 46 (see FIG. 1). During a switching process to the right, the switching units 1, 2 move into a main extension direction 60 opposite thereto (see FIGS. 5*a* and 5*b*). The switching processes to the right and to the left respectively consist of two switching processes, in which the individual switching units 1, 2 are moved in the axial direction relative to the switching means 3, 4.

In the following, the switching process to the right is performed. In a first step according to FIGS. 4*a* and 4*b*, the right switching means 3 is moved into the plunging section 9 of the control track 6 by the actuator 65 (see FIG. 1) based on a signal given in the form of a magnetic field by the actuator 65. In a second step according to FIGS. 5*a* and 5*b*, the right switching means 3 is in the actuation section 12 of the control track 6 and starts to displace the right switching unit 2 in the main extension direction 60 of the camshaft 46 (see FIG. 1), which is an axial direction. In a third step according to FIGS. 6*a* and 6*b*, the displacement of the right switching unit is slowed down and is then completed. After the displacement of the switching unit 2, which is a position change relative to the switching means 3, 4, the switching means 3 actuates the switching unit 1. In a fourth step according to FIGS. 7*a* and 7*b*, the right switching means is just before the actuation section 11 of the control track 6 of the switching unit 1. In a fifth step according to FIGS. 8*a* and 8*b*, the right switching means 3 is in the actuation section 11 of the control track 6 of the left switching unit 1 and starts its displacement in the main extension direction 60. In a sixth step according to FIGS. 9*a* and 9*b*, the displacement of the left switching unit 1 is completed. In a seventh step according to FIGS. 10*a* and 10*b*, the right switching means 3 is in the push-out section 14 of the control track 6 of the right switching unit 2 and is pushed back into the starting position in the direction of a vertical axis 19, which proceeds in the radial direction relative to the camshaft 46 (see FIG. 1). In an eighth step according to FIGS. 11*a* and 11*b*, the right switching means 3 is again in the starting position. The two switching processes, in which the switching units 1, 2 are displaced to the right relative to the switching means 3, 4, thus proceed in an automated manner, after the actuator 64 or the actuator 65 (see FIG. 1) has issued the signal, with a rotating camshaft 46, that is, without further signals coming from the outside of the implementation unit 38. The same is true for the switching processes, in which the switching units 1, 2 are displaced successively to the left. Even though an angular speed with which the camshaft 46 rotates, can change to the left or to the right during the first half of a switching process, in which a switching unit 1, 2 is displaced, the second half of the switching process, in which the other switching unit 1, 2 is displaced axially in the same direction, takes place in an automated manner and independently of an electronic evaluation.

The switching process to the left is described in the following. In a first step according to FIGS. 12*a* and 12*b*, the left switching means 4 is moved into the plunging section 10 of the control track 5 by the actuator 64 (see FIG. 1) based on a signal given by the actuator 64. In a second step according to FIGS. 13*a* and 13*b*, the left switching means 4 is just before the start of the actuation section 11 of the control track 5 in the left switching unit 1. In a third step according to FIGS. 14*a* and 14*b*, the left switching means 4 is in the actuation section 11 of the control track 5 of the left switching unit 1 and starts to displace the left switching unit 1 into the main extension direction 62, which is also an axial direction. In a fourth step according to FIGS. 15*a* and 15*b*, the displacement of the left switching unit 1 to the left is completed. In a fifth step according to FIGS. 16*a* and 16*b*, the displacement of the right switching unit 2 starts in the main extension direction 62 to the left. So as to displace the switching units 1, 2 to the left, the switching means 4 thus has to actuate the switching units 1, 2 independently of each other. In a sixth step according to FIGS. 17*a* and 17*b*, the displacement of the right switching unit is slowed down and is then completed. In a seventh step according to FIGS. 18*a* and 18*b*, the left switching means 4 is in the push-out section 13 of the control track 5 of the left switching unit 1 and is pushed back into the starting position in the direction of a vertical axis 20. In an eighth step according to FIGS. 19*a* and 19*b*, the left switching means 4 is again in the starting position. With a change of the switching means 4 from one switching unit 1, 2 to another switching unit 1, 2, both switching units 1, 2 are actuated simultaneously. The analog is valid for the switching process to the right. The switching means 3, 4 correspond to the switching units 1, 2 with all described switching processes.

The two switching units 1,2 can be actuated by the switching means 3, 4 in a defined switching sequence based on the configuration of the control tracks 5, 6. The switching processes to the left and to the right can thus be repeated as often as desired in an alternate manner in principle. The switching units 1, 2 are thereby always brought into different switching states to the plunging, actuation, changing and resting.

The switching units 1, 2 are displaced individually and successively in the same direction to the left or to the right during the switching processes to the left or to the right. The switching units 1, 2 are thus also partially decoupled in their movement in the main extension direction of the camshaft 46 (see FIG. 1).

It can be seen by means of the described switching processes that switching processes to the left are performed by means of the left switching means 4, and switching processes to the right are performed by means of the right switching means 3. A switching direction is respectively associated with each switching means 3, 4.

With the described switching of the valve drives, the valve lift curves of valves are changed, which are opened and closed based on the rotation of the camshaft 46 in one operating mode. Valves can further be switched off by the switching and thus remain closed. A change of the operating modi of the internal combustion engine can accompany a change of the valve lift curves.

An alternative embodiment is shown in FIGS. 20 to 23. The same components, characteristics and functions are essentially referenced with the same reference numerals. For distinguishing the embodiments, the letter "a" is added to the reference numerals of the alternative embodiment in FIGS. 20 to 23. The following description is essentially restricted to the differences to the embodiment in FIGS. 1 to 19, wherein the description of the embodiment in FIGS. 1 to 19 can be referred to with regard to the same components, characteristics and functions.

Figure 20:
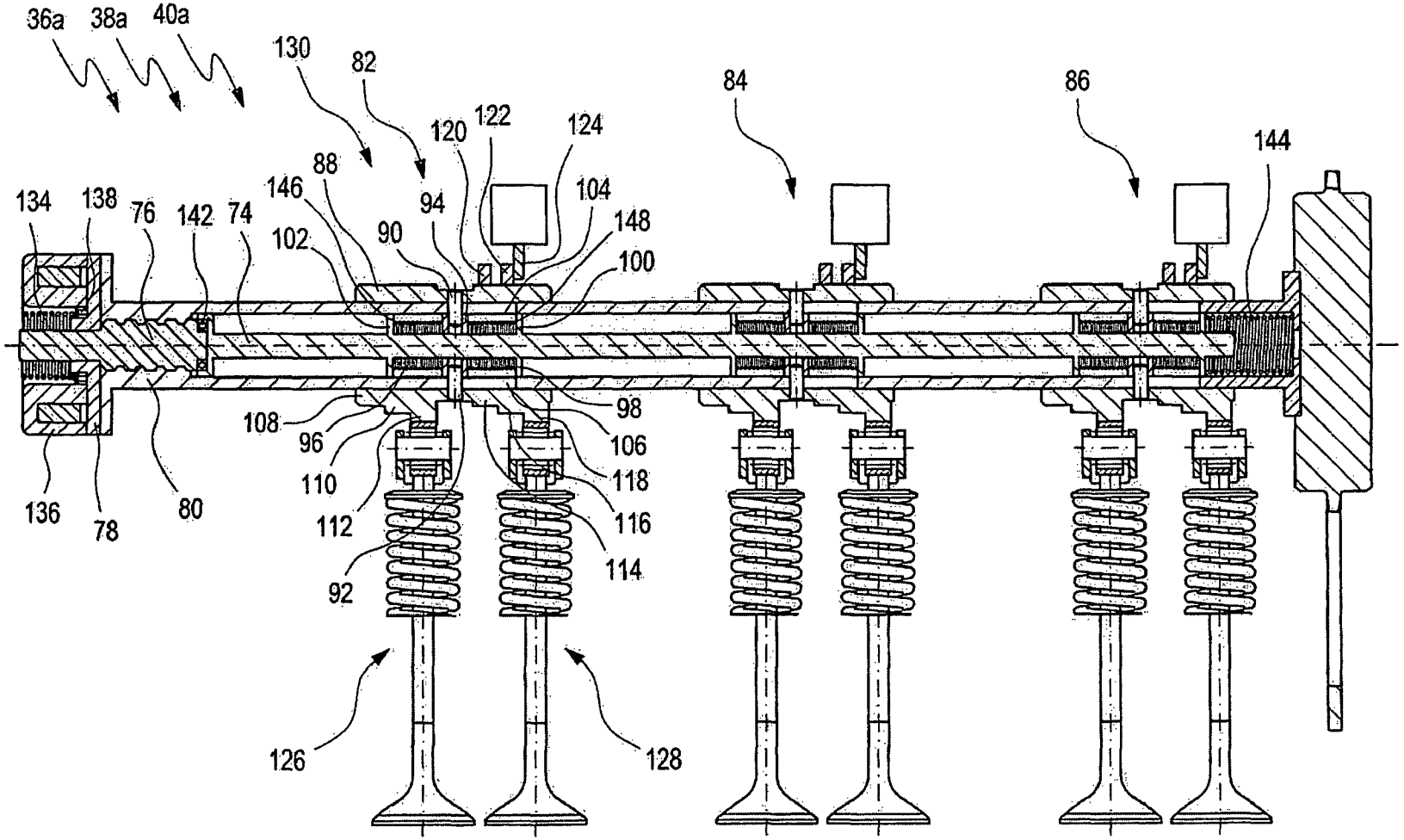

FIG. 20 shows a section through an alternative embodiment of an internal combustion engine valve drive switching device with a switching unit 36*a*. The switching unit 36*a* comprises an implementation unit 38*a* and a camshaft 80. The implementation unit 38*a* comprises three cylinder valve actuating units 82, 84, 86, which altogether actuate either the outlet and/or the inlet valves of a cylinder bank with several cylinders. The implementation unit 38*a* only has mechanical components and is thus formed as a mechanical unit 40*a*. As the cylinder valve actuating units 82, 84, 86 are identical in construction, only one is described in the following: The cylinder valve actuating unit 82 comprises a cam segment 88, which encloses a shaft part of the camshaft 80 in the circumferential direction or which is formed in the shape of a sleeve and which is mounted in an axially displaceable manner on the shaft part of the camshaft 80 in the direction of the main extension direction of the camshaft 80. The cam segment 88 is connected to a switching piece 84 with the help of coupling bolts 90, 92. The switching piece 94 is clamped between two ends of coil springs 96, 98. The coil springs 96, 98 are identical to energy storage elements 146, 148. The deflection direction of the coil springs 96, 98 is identical to the main extension direction of the camshaft 80. The ends of the coil springs 96, 98 turned away from the switching piece 94 act on spring support plates 100, 102, which are rigidly connected to a switching means 74. The switching means 74 is formed as a connecting rod. Its main extension direction is identical to the main extension direction of the camshaft 80. The switching means 74 has rotational symmetry, wherein the direction of the symmetry axis is identical to its main extension direction. The symmetry axis corresponds to the rotational axis of the camshaft 80. The camshaft 80 is formed as a hollow shaft. The switching means 74 extends in the interior of the camshaft 80. The coil springs 96, 98 and the switching piece 94 are also in the interior of the camshaft 80. The coupling bolts 90, 92 run in the radial direction with regard to the camshaft 80. The cam segment 88 has cams 108, 110, 112, 114, 116, 118. The cams 108 to 112 are associated with a first valve 126, and the cams 114 to 118 are associated with a second valve 128. The two valves 126, 128 are associated with the same cylinder. Switching elements 120, 122 are arranged on the cam segment 88, which elements extend relative to the camshaft 80 in the circumferential direction over a camshaft rotary angle region, which is smaller than 360 degrees. The switching elements 120, 122 are contacted by a switching element 124 with different camshaft rotary angles, which element is resting relative to the positions of the valves 126, 128 closing the cylinder. The switching elements 120, 122, 124 form a switching unit 130 together with the coupling bolts 90, 92, the switching piece 94, the spring plates 100, 102, and the coil springs 96, 98.

A threaded spindle 76 is fastened to one end of the switching means 74 by means of a form-fit. A switching means reset spring 44 is at the opposite end of the switching means 74 between the switching means 74 and the camshaft 80, which reset spring can be compressed by a movement of the switching means 74 in the main extension direction of the switching means 74.

Figure 21:
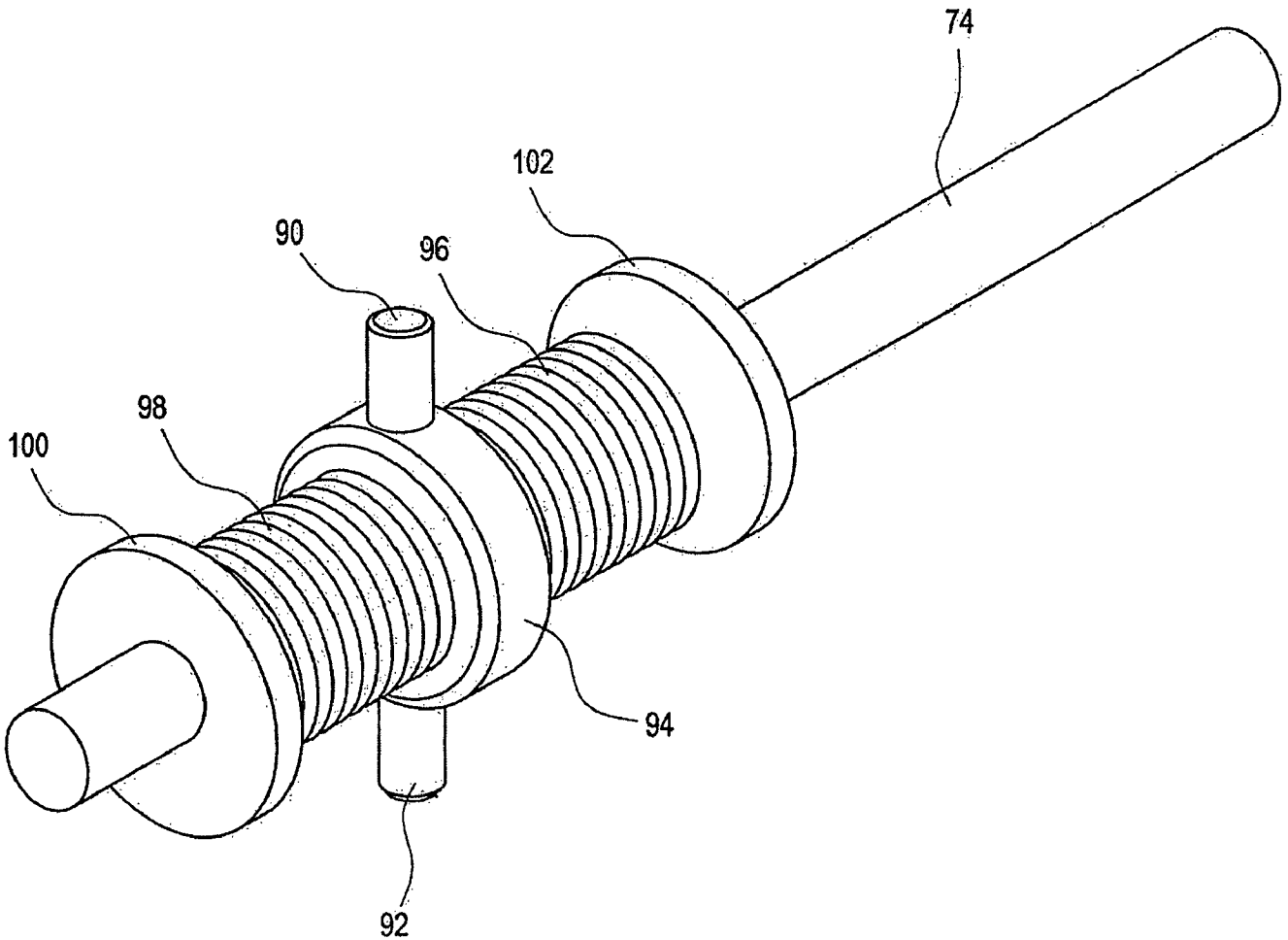

FIG. 21 shows a part of the switching unit 130 together with a part of the switching means 74. The two coupling bolts 90, 92 are fastened in the opposite direction at the switching piece 94. The two coil springs 96, 98 are pre-tensioned against each other in the main extension direction of the switching means 74 with the help of the spring support plates 100, 102. The switching piece 94 is between the coil springs 96, 98. The switching piece 94 can be moved in the main extension direction of the switching means 74 relative to the switching means 74 by means of a compression of the coil spring 96 or 98.

Figure 22:
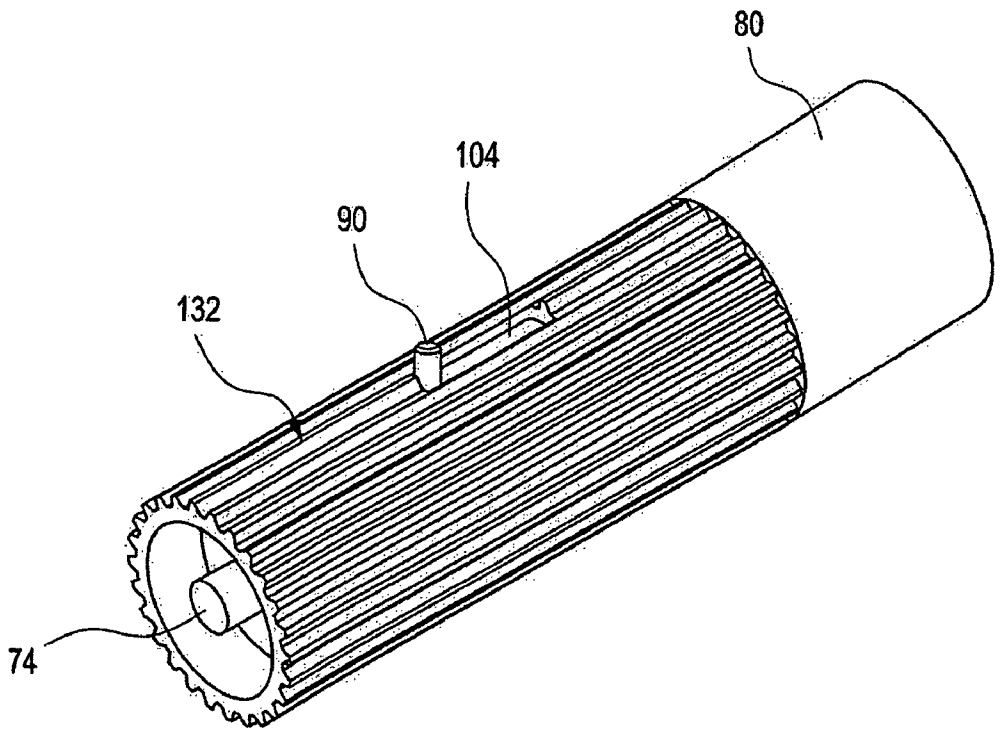

FIG. 22 shows the shaft part of the camshaft 80, which is enclosed by the cam segment 88 in the assembled state. A contact surface 132, where the cam segment 88 (see FIG. 20) can contact the shaft part, has a longitudinal gearing. This permits the cam segment 88, which has a corresponding longitudinal gearing on a surface facing the shaft part in the assembled state, a movement relative to the shaft part in the axial direction and prevents a relative movement in the circumferential direction. The coupling bolt 90 projects through a recess 104, which permits the coupling bolt 90 a movement in the axial direction. An analogous recess 106 (see FIG. 20) exists for the coupling bolt 92.

Figure 23:
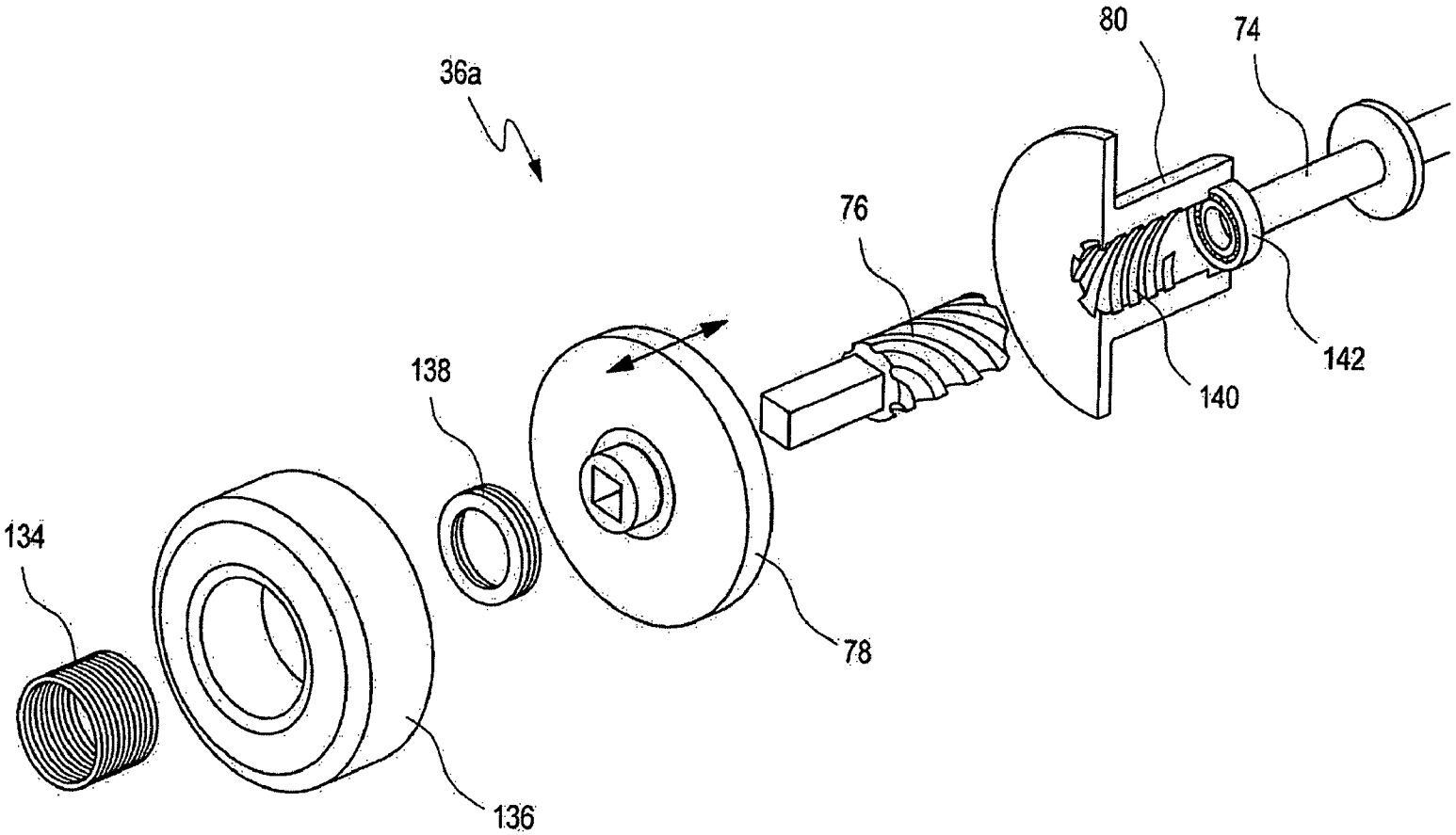

FIG. 23 shows a magnetic stator 136 and a part of the implementation unit 38*a* with the threaded spindle 76 in an exploded view. The construction of this part of the implementation unit 38*a* is described in the following in the assembled state. The threaded spindle 76 is screwed into a threaded nut 140, which is formed by an end of the camshaft 80 and is connected to the switching means 74 by means of a form fit in such a manner that the threaded spindle 76 is unmovable relative to the switching means 74 in the main extension direction of the switching means 74. The switching means 74 has an axial bearing 142 at the side facing the threaded spindle 76, which mounts the threaded spindle 76 and the switching means 74 to each other around the rotational axis of the camshaft 80 in a rotatable manner. The threaded spindle 76 has a cuboidal part, which mounts a rotor 78 in the main extension direction of the switching means 74 in a movable manner. The threaded spindle 76 and the rotor 78 can be moved relative to each other in the circumferential direction of the camshaft 80. The threaded spindle 76 is connected to the switching means 74 by means of the axial bearing 142. A movement of the shaft part of the camshaft 80 and of the threaded spindle 76 in the circumferential direction relative to the resting magnetic stator 136 is hereby decoupled from the switching means 74. A rotation of the rotor 78 in the circumferential direction of the camshaft 80 is decoupled from a rotor reset spring 134 by means of an axial bearing 138. The rotor reset spring 134 presses the rotor 78 in the direction of the threaded nut 140 away from the magnetic stator 136. The magnetic stator 136 has a solenoid, by which the rotor 78 can be attracted.

A switching process of the alternative embodiment of an internal combustion engine valve drive switching device can now take place in the following manner. The magnetic stator 136 passes a signal to the implementation unit 38*a* by attracting the rotor 78 with the help of the solenoid, so that the rotor 78 abuts the magnetic stator 136 and is resting relative to the magnetic stator 136. Rotations of the threaded spindle 76 around the symmetry axis of the switching means 74 relative to the magnetic stator 136 are prevented hereby. As the threaded nut 140 implements the rotations of the shaft part of the camshaft 80, the threaded nut 140 rotates relative to the threaded spindle 76. An axial displacement of the threaded spindle 76 and of the switching means 74 thus takes place due to the thread in the main extension direction of the switching means 74 away from the magnetic stator 136 relative to the shaft part of the camshaft 80, whereby the switching means reset spring 144 is compressed. The coil spring 96 is further compressed hereby, whereby the coupling bolts 90, 92 exert forces in the main extension direction of the switching means 74 away from the magnetic stator 136 to the cam segment 88. These forces are initially compensated by a force which the switching element 124 exerts on the switching element 122 by means of contacting. If the switching element 124 now stops to contact the switching element 122 due to the camshaft rotation, these forces displace the cam segment 88 in the main extension direction of the switching means 74 away from the magnetic stator 136, until the switching element 124 contacts the switching element 120. The cams 112 and 118, which were responsible for a full stroke of the valves 126, 128 in the starting position, are deactivated due to the axial displacement of the cam segment 88, and the cams 110, 116 are activated, which effect a partial stroke. The coil spring 96 remains compressed hereby compared to the starting position, so that further forces act upon the cam segment 88 in the main extension direction of the switching means 74 away from the magnetic stator 136. These forces are compensated due to the contacting of the switching elements 124, 120. If the switching element 124 now stops to contact the switching element 120 due to the camshaft rotation, the forces effected on the cam segment 88 by the coil spring 96 achieve a further axial displacement of the cam segment 88 in the main extension direction of the switching means 74 away from the magnetic stator 136. The cams 110, 116 are thereby deactivated and the cams 108, 114 are activated, which effects a switching of the valves 126, 128 from a partial stroke to a zero stroke. The switching elements 120, 122, 124 thus form a geometric coding for two switching processes. If the rotor abuts neither the magnetic stator 136 nor the camshaft 80, the compressed switching means reset spring 144 can move the switching means 74 relative to the shaft part of the camshaft 80 in the main extension region of the switching means 74 towards the magnetic stator. The valve lift curves of the valves 126, 128 are hereby switched from zero stroke to full stroke. The other cylinder valve actuation units 84, 86 are also switched in an analogous manner.

What is claimed is:

1. An internal combustion engine valve drive switching device having a cam shifting arrangement, including an implementation unit (38) with first and second switching units (1, 2) which are movable relative to each other by switching means (3, 4) provided to actuate first one of the switching units (1, 2) for a position change thereof relative to the switching means (3, 4) followed by a position change of the other switching unit (2, 1), to implement a first switching process followed by a second switching process.

2. The internal combustion engine valve drive switching device according to claim 1, wherein the implementation unit (38) is provided to actuate the switching units (1, 2) in at least one operating mode independently of each other at least in dependence on the positions of the switching units (1, 2) relative to the switching means (3, 4).

3. The internal combustion engine valve drive switching device according to claim 1, wherein the switching units (1, 2, 130) are at least partially decoupled in their movement.

4. The internal combustion engine valve drive switching device according to claim 1, wherein the implementation unit (38) has at least two control means (52, 54), which are positioned on ends (54, 58) of the at least two of the switching units (1, 2) of the implementation unit (38) so as to face each other.

5. The internal combustion engine valve drive switching device according to claim 4, wherein the control means (52, 54) form at least one control track (5, 6).

6. The internal combustion engine valve drive switching device according to claim 1, including at least one control track (5, 6), which is formed by the two switching units (1, 2) of the implementation unit (38).

7. The internal combustion engine valve drive switching device according to claim 6, wherein the control track (5, 6) is formed in such a manner that the switching units (1, 2) can be actuated by a switching means (3, 4) in a defined switching sequence.

8. The internal combustion engine valve drive switching device according to claim 6, wherein, the switching means (3, 4), is provided for acting on the at least one control track (5, 6) in at least one radial direction.

9. The internal combustion engine valve drive switching device according to claim 1, wherein the implementation unit (38) includes a camshaft (46, 80), with which the switching units (1, 2, 130) are associated and via which valve lift curves of valves associated with the camshaft (46, 80) can be changed.

10. The internal combustion engine valve drive switching device according to claim 1, wherein the implementation unit (38) has the switching units (1, 2) and the switching means (3, 4), are provided to effect an axial displacement of the switching unit (1, 2) relative to the switching means (3, 4) by an interaction with each other, and thereby effect a switching of at least one valve drive.

11. The internal combustion engine valve drive switching device according to claim 1, wherein the switching units (1, 2, 130), are axially displaceable parts of a camshaft (46, 80) with cams (7, 8, 26, 27, 28, 29, 30, 31, 48, 50, 108, 110, 112, 114, 116, 118) having different contours.

12. The internal combustion engine valve drive switching device according to claim 1, wherein the implementation unit (38*a*) has at least one switching unit (130) with at least one energy storage element (146, 148), which is provided to at least partially store energy released during a switching process.

13. The internal combustion engine valve drive switching device according to claim 1, wherein, the implementation unit (38*a*) comprises a switching means (74), in the form of a connecting rod.

14. The internal combustion engine valve drive switching device according to claim 1, wherein the implementation unit (38*a*) has at least one switching means (74), at least one rotor (78) and at least one threaded spindle (76), which is provided to displace the switching means (74) axially in cooperation with the rotor (78).

* * * * *